US006668943B1

(12) United States Patent
Maus et al.

(10) Patent No.: US 6,668,943 B1
(45) Date of Patent: Dec. 30, 2003

(54) METHOD AND APPARATUS FOR CONTROLLING PRESSURE AND DETECTING WELL CONTROL PROBLEMS DURING DRILLING OF AN OFFSHORE WELL USING A GAS-LIFTED RISER

(75) Inventors: L. Donald Maus, Houston, TX (US); Torney M. Van Acker, Fairfax Station, VA (US); Mark E. Ehrhardt, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 33 days.

(21) Appl. No.: 09/584,526

(22) Filed: May 31, 2000

Related U.S. Application Data

(60) Provisional application No. 60/137,286, filed on Jun. 3, 1999.

(51) Int. Cl.[7] ..... E21B 7/12

(52) U.S. Cl. ..... 175/5; 175/25; 175/38; 175/48; 175/212

(58) Field of Search ..... 175/5, 7, 25, 38, 175/48, 212, 218

(56) References Cited

U.S. PATENT DOCUMENTS

| | | | | |
|---|---|---|---|---|
| 3,470,972 A | * | 10/1969 | Dower | 175/25 |
| 3,603,409 A | | 9/1971 | Watkins | 175/7 |
| 3,811,322 A | * | 5/1974 | Swenson | 175/48 |
| 3,815,673 A | | 6/1974 | Bruce et al. | 166/0.5 |

(List continued on next page.)

FOREIGN PATENT DOCUMENTS

| | | |
|---|---|---|
| WO | WO 98/16716 | 4/1998 |
| WO | WO 99/18327 | 4/1999 |

OTHER PUBLICATIONS

Lopes, C.A. and Bourgoyne, A. T., Jr., "Feasibilty Study of a Dual Density Mud System for Deepwater Drilling Operations", OTC 8465, Offshore Technology Conference, May 5–8, 1997; pp. 257–266.

Lopes, C. A., "Feasibility Study on the Reduction of Hydrostatic Pressure in a Deep Water Riser Using a Gas–Lift Method", Ph.D dissertation submitted to Louisiana State University, May 1997.

Maus, L. D., et al., "Instrumentation Requirements for Kick Detection in Deep Water", Journal of Petroleum Technology, Aug. 1979, pp. 1029–1034.

Maus, L. D., et al., "Sensitive delta–flow method detects kicks or lost returns", Oil & Gas Journal, Aug. 20, 1979, pp. 125–132.

(List continued on next page.)

*Primary Examiner*—Heather Shackelford
*Assistant Examiner*—John Kreck
(74) *Attorney, Agent, or Firm*—Keith A. Bell; Nelson V. Jaramillo; Gary P. Katz

(57) ABSTRACT

A method and apparatus for controlling the riser base pressure and detecting well control problems, such as kicks or lost circulation, during drilling of an offshore well using a gas-lifted riser. The pressure control apparatus preferably includes two separate control elements, one to adjust the pressure at the surface ($p_{rs}$) and the mass flow rate out of the top of the riser ($\dot{m}_o$) to compensate for changes in riser base pressure ($p_{rb}$) and the other to adjust either or both of the boost mud flow rate ($q_b$) and lift gas flow rate ($q_g$) to maintain a constant or nearly constant mass flow rate entering the base of the riser ($\dot{m}_i$). According to the method of the present invention, the well return flow rate ($q_w$) is preferably determined by directly measuring various other parameters and then computing $q_w$ from the measured parameters. The computed value of $q_w$ may be compared to the drill string flow rate ($q_c$) to detect well control problems, such as kicks or lost circulation.

25 Claims, 12 Drawing Sheets

U.S. PATENT DOCUMENTS

| | | | | | |
|---|---|---|---|---|---|
| 3,911,740 | A | | 10/1975 | Calhoun | 73/153 |
| 3,955,411 | A | * | 5/1976 | Lawson, Jr. | 175/48 |
| 3,976,148 | A | | 8/1976 | Maus et al. | 175/7 |
| 4,046,191 | A | | 9/1977 | Neath | 166/0.5 |
| 4,063,602 | A | * | 12/1977 | Howell et al. | 175/7 |
| 4,091,881 | A | | 5/1978 | Maus | 175/7 |
| 4,099,583 | A | | 7/1978 | Maus | 175/7 |
| 4,210,208 | A | | 7/1980 | Shanks | 166/352 |
| 4,216,834 | A | | 8/1980 | Wardlaw | 175/7 |
| 4,220,207 | A | | 9/1980 | Allen | 166/367 |
| 4,291,772 | A | | 9/1981 | Beynet | 175/5 |
| 4,440,239 | A | | 4/1984 | Evans | 175/5 |
| 4,610,161 | A | * | 9/1986 | Gehrig et al. | 175/48 |
| 4,813,495 | A | | 3/1989 | Leach | 175/6 |
| 4,879,654 | A | | 11/1989 | Bruce | 364/422 |
| 5,006,845 | A | | 4/1991 | Calcar et al. | 340/853 |
| 5,163,029 | A | * | 11/1992 | Bryant et al. | 175/48 |
| 5,168,932 | A | * | 12/1992 | Worrall et al. | 175/48 |
| 5,184,686 | A | | 2/1993 | Gonzalez | 175/5 |
| 5,249,635 | A | | 10/1993 | King et al. | 175/48 |
| 5,873,420 | A | | 2/1999 | Gearhart | 175/25 |

OTHER PUBLICATIONS

Le Blanc, L., "Riserless drilling JIP moving to second phase—development", Offshore, Dec. 1997, pp. 31–34.

Shaughnessy, J. M. and Herrmann, R. P., "Concentric riser will reduce mud weight margins, improve gas–handling safety", Oil & Gas Journal, Nov. 2, 1998, pp. 54–62.

Choe, J., "Analysis of Riserless Drilling System and Well Control with a Windows–Based User–Interactive Program".

Choe, J., "Analysis of Riserless Drilling and Well–Control Hydraulics", SPE Drilling & Completion, vol. 14, Mar. 1999, pp. 71–81.

Choe, J. and Juvkam–Wold, H. C., "Well Control Aspects of Riserless Drilling", SPE 49058, presented at the 1998 SPE Annual Technical Conference and Exhibition, New Orleans, Louisiana, Sep. 27–30, 1998; pp. 355–366.

Nessa, D. O., et al., "Offshore underbalanced drilling system could revive field developments", Part 1, World Oil, Jul. 1997, pp. 61–66.

Nessa, D. O., et al., "Offshore underbalanced drilling system could revive field developments", Part 2, World Oil, Oct. 1997, pp. 83–88.

Sangesland, S., "Riser Lift Pump for Deep Water Drilling", Paper No. IADC/SPE 47821, 1998 IADX/SPE Asia Pacific Drilling Conference, Jakarta, Indonesia, Sep. 7–9, 1998, pp. 299–309.

* cited by examiner

METHOD AND APPARATUS FOR CONTROLLING PRESSURE AND DETECTING WELL CONTROL PROBLEMS DURING DRILLING OF AN OFFSHORE WELL USING A GAS-LIFTED RISER

This application claims the benefit of U.S. Provisional Application No. 60/137,286 filed Jun. 3, 1999.

FIELD OF THE INVENTION

This invention relates generally to offshore well drilling operations. More particularly, the invention pertains to gas-lifted risers for use in drilling offshore wells. Specifically, the invention is a method and apparatus for controlling the riser base pressure and detecting well control problems, such as kicks or lost circulation, during drilling of an offshore well using a gas-lifted riser.

BACKGROUND OF THE INVENTION

In recent years the search for offshore deposits of crude oil and natural gas has been moving into progressively deeper waters. In deep waters, it is common practice to conduct drilling operations from floating vessels or platforms. The floating vessel or platform is positioned over the subsea wellsite and is equipped with a drilling rig and associated drilling equipment.

To conduct drilling operations from a floating vessel or platform, a large diameter pipe known as a "drilling riser" is typically employed. The drilling riser extends from above the surface of the body of water downwardly to a wellhead located on the floor of the body of water. The drilling riser serves to guide the drill string into the well and provides a return conduit for circulating drilling fluids.(also known as "drilling mud" or simply "mud").

An important function performed by the circulating drilling fluids is well control. The column of drilling fluid contained within the wellbore and the drilling riser exerts hydrostatic pressure on the subsurface formation which overcomes formation pore pressure and prevents the influx of formation fluids into the wellbore, a condition known as a "kick." However, if the column of drilling fluid exerts excessive hydrostatic pressure, the reverse problem can occur, i.e., the pressure of the drilling fluid can exceed the natural fracture pressure of one or more of the exposed (i.e., uncased) subsurface formations. Should this occur, the hydrostatic pressure of the drilling fluid could initiate and propagate a fracture in the formation, resulting in drilling fluid loss to the formation, a condition known as "lost circulation." Excessive fluid loss to one formation can result in loss of well control in other formations being drilled, thereby greatly increasing the risk of a blowout. Thus, proper well control requires that the hydrostatic pressure of the drilling fluid adjacent an exposed formation be maintained above the formation's pore pressure, but below the formation's natural fracture pressure.

For a conventional offshore drilling system in which the drilling fluid contained in the wellbore and the drilling riser constitutes a continuous fluid column from the bottom of the well to the surface of the body of water, it is increasingly difficult, as water depth increases, to maintain the pressure of the drilling fluid in the wellbore between the formation pore pressure and the natural fracture pressure of the exposed formations. This problem is well known in the art. See, e.g., Lopes, C. A. and Bourgoyne, A. T., Jr., *Feasibility Study of a Dual Density Mud System for Deepwater Drilling Operations*, OTC 8465, Offshore Technology Conference, May 5–8, 1997. Because of this problem, the allowable length of exposed borehole is severely limited and frequent installations of protective casing strings are required. This, in turn, results in longer times and higher costs to drill the well.

It has long been recognized that one solution to this problem is to maintain the drilling fluid pressure at the wellhead (i.e., at the elevation of the floor of the body of water) approximately equal to that of the surrounding seawater. This effectively eliminates the problems resulting from the fact that drilling fluid typically has a higher density than seawater. Several methods of accomplishing this have been proposed, including injection of a gas ("lift gas") such as nitrogen into the lower end of the drilling riser. Lift gas injected into the drilling riser intermingles with the returning drilling fluid and reduces the equivalent density of the column of drilling fluid in the riser to that of seawater. The column of drilling fluid in the well below the lift gas injection point does not contain lift gas and, accordingly, is denser than the drilling fluid in the riser. Hence, this approach provides a "dual density" circulation system. U.S. Pat. No. 3,815,673 (Bruce et al.) discloses an example of such a "gas-lifted drilling riser" in which an inert gas is compressed, transmitted down a separate conduit, and injected at various points along the lower end of the drilling riser. Bruce et al. also disclose a control system responsive to the hydrostatic head of the drilling fluid which controls the rate of lift gas injection into the riser in order to maintain the hydrostatic pressure at the desired level.

U.S. Pat. No. 3,603,409 (Watkins) illustrates a variation of the gas-lifted drilling riser concept in which the drilling riser is replaced by a separate drilling fluid return conduit. The drill string enters the well through a rotating blowout preventer (BOP) located on top of the subsea wellhead, and alternate means for guiding the drill string into the well are provided. According to Watkins, lift gas is injected into the wellhead in an amount sufficient to cause the density of the drilling fluid in the separate return conduit to approximate the density of seawater.

Unfortunately, two major problems have prevented practical application of gas-lifted risers. The first is pressure control. Simulations and tests of the behavior of gas-lifted risers have shown that it is extremely difficult to maintain a constant value of the riser base pressure ($p_{rb}$) due to unavoidable variations in the flow rate or density of the drilling fluid in the riser. An example of such unavoidable variation is the interruption of flow required to add a length (joint) of drill pipe to the drill string as the well is drilled deeper. Riser base pressure ($p_{rb}$) is the integrated result of the varying density of the entire column of drilling fluid and lift gas in the riser and is particularly influenced by the rapidly expanding lift gas near the top of the riser. The effects on $p_{rb}$ of a momentary (i.e., two to three minutes) change in flow conditions at the base of a gas-lifted riser in 10,000 feet (3,048 meters) of water will persist for as long as about an hour and a half as the affected "packet" of drilling fluid and lift gas moves up the riser. The largest effect occurs as the mixture approaches the surface. Therefore, simply sensing $p_{rb}$ and adjusting the lift gas flow rate to respond to drilling fluid flow changes over intervals of several minutes leads to large instabilities in $p_{rb}$.

The second major problem that has prevented practical application of gas-lifted risers is detection of well control problems such as kicks and lost circulation. It is well known that the most sensitive method of detecting kicks or lost circulation is to measure the rate of return flow of drilling fluid from the well and to compare it with the rate of flow of drilling fluid being pumped into the well via the drill pipe (see e.g., Maus, L. D., et al., Instrumentation Requirements for Kick Detection in Deep Water, Journal of Petroleum Technology, August 1979, pp. 1029–34). This may readily be accomplished provided the volume of fluid in the circulation system between the points of measurement of the input and return flow rates is constant or known. However, with a gas-lifted riser upstream of the return flow measurement point, there is the potential for unknown and varying volumes of fluid in the circulation system due to the presence of lift gas in the riser. This uncertainty significantly impedes the early detection of kicks or lost circulation.

In the late 1970s, two approaches to controlling gas-lifted drilling risers were proposed. U.S. Pat. No. 4,091,881 (Maus '881) envisioned diverting the return flow of drilling fluid from the upper portion of the drilling riser, through a throttling valve, and into a separate return conduit where the lift gas was injected. The rates of lift gas injection into the return conduit and drilling fluid withdrawal from the drilling riser were controlled to maintain the hydrostatic pressure of the drilling fluid remaining in the drilling riser and wellbore at or below the fracture pressure of the formation. This method has the disadvantage of requiring one or more separate conduits for returning the drilling fluid to the surface and the continuous use of a throttling valve in very severe service (drilling fluid with cuttings).

U.S. Pat. No. 4,099,583 (Maus '583) disclosed a variation of the gas-lifted drilling riser concept which used a seawater-based drilling fluid. According to this variation, lift gas is injected into the drilling fluid to provide the lift necessary to return the drilling fluid to the surface and to reduce its density. Lift gas injection is maintained at a rate that overlifts the drilling fluid to the extent that the hydrostatic pressure of the drilling fluid is reduced to less than that of the ambient seawater surrounding the drilling riser. Seawater is permitted to flow into the lower end of the riser in response to the differential pressure between the drilling fluid and the seawater so that the pressure of the drilling fluid becomes approximately equal to that of the ambient seawater. The method disclosed in the Maus '583 patent applies only to drilling the upper part of an offshore well where seawater may be used as the drilling fluid. This method would not be suitable for drilling fluids based on fresh water, oil, or synthetic fluids (such as are typically used in drilling the deeper portions of offshore wells) because of contamination with seawater.

More recently, a gas-lifted drilling riser system was described by workers at Louisiana State University (Lopes et al., supra). With respect to the problem of pressure control during drill pipe connections, Lopes et al. stated that "[t]he foreseen solution to this problem is to keep the gas injection going, but at a much lower rate, determined by the automatic controller, equal to the rate with which the gas is migrating." Unfortunately, as noted above, adjusting the lift gas flow rate to respond to drilling fluid flow changes over intervals of several minutes can lead to large instabilities in the riser base pressure ($p_{rb}$). Lopes, et al. also briefly discuss a variety of kick detection techniques, none of which is believed to be as sensitive, reliable, and practical as that of the present invention.

Another potential solution to the problems encountered in drilling offshore wells in deep waters is disclosed in U.S. Pat. No. 4,813,495 (Leach). According to Leach, drilling fluid returns are taken at the seafloor, and the drilling fluid is then pumped to the surface through a separate return riser by a centrifugal pump that is powered by a seawater driven turbine. The drill string enters the well through a rotating pressure head located on top of the subsea wellhead. By taking the drilling fluid returns at the seafloor, the pressure of the drilling fluid column in the return riser is removed from the formation. Unfortunately, the large subsea pumps used to pump the drilling fluid from the seafloor back to the surface are quite expensive and difficult to maintain. Moreover, the absence of a conventional drilling riser means that it is not possible to revert to normal drilling operations if problems are encountered.

From the foregoing, it can be seen that there is a need for an improved method and apparatus for controlling pressure and detecting well control problems with a gas-lifted riser. Such method and apparatus should be capable of maintaining the riser base pressure ($p_{rb}$) relatively constant despite unavoidable variations in drilling fluid flow rate or drilling fluid density. Such method and apparatus should also be capable of quickly and accurately detecting kicks or lost circulation. The present invention satisfies this need.

SUMMARY OF THE INVENTION

The present invention is a method and apparatus for controlling the pressure at the base of a gas-lifted riser during drilling of an offshore well. Preferably, the internal pressure at the base of the riser should be maintained approximately equal to the ambient seawater pressure at that depth despite variations in the flow rate and/or density of the well return flow. The invention may also be utilized to detect well control problems, such as kicks or lost circulation, during drilling of an offshore well using a gas-lifted riser.

In one embodiment, the inventive pressure control system comprises two complementary control elements. The first element adjusts the pressure at the surface and the mass flow rate out of the top of the riser to compensate for changes in riser base pressure due to variations in the mass flow rate entering the riser. The second element adjusts either or both of the boost mud flow rate and the lift gas flow rate to maintain a substantially constant mass flow rate entering the riser. In some situations, either the first element or the second element alone may provide satisfactory control.

The pressure control system operates by measuring a number of operating parameters of the gas lift system and, based on these measurements, calculating the adjustments necessary to maintain the riser base pressure within the desired control range. The invention also compares the well return flow rate (i.e., the flow rate prior to the injection of lift gas or boost mud) to the drill string flow rate so as to detect well control problems. Preferably, these control operations are performed on a substantially continuous basis throughout the gas-lifting operation. Alternatively, the control operations may be performed on a frequently recurring basis, at regular or irregular intervals.

The inventive pressure control system may be used in conjunction with either a gas-lifted drilling riser or a separate gas-lifted mud return riser. The pressure control system may be utilized in any water depth, but is especially advantageous in extremely deep waters (i.e., waters deeper than about 5,000 feet (1,524 meters)).

BRIEF DESCRIPTION OF THE DRAWINGS

The present invention and its advantages may be better understood by referring to the detailed description set forth below and the attached drawings in which.

DETAILED DESCRIPTION OF THE INVENTION

The invention will be described in connection with its preferred embodiments. However, to the extent that the following detailed description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

Gas-lifted Risers in General

Figure 1B:
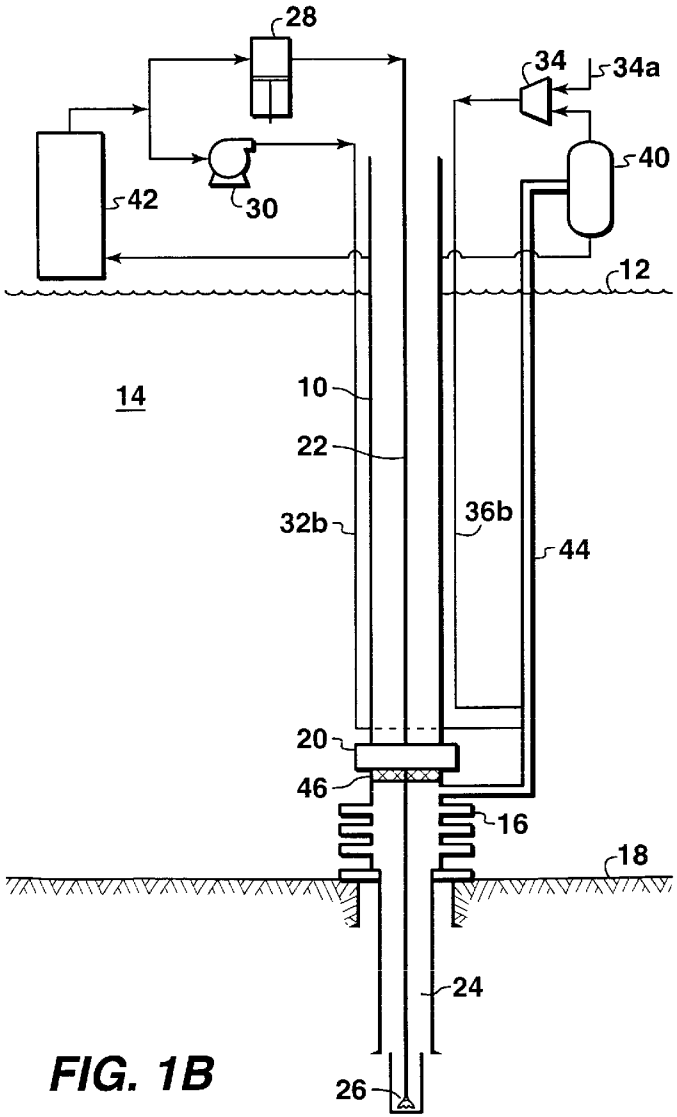
FIGS. 1A and 1B illustrate, respectively, schematic overviews of offshore drilling operations using a gas-lifted drilling riser and offshore drilling operations using a separate gas-lifted mud return riser.
Figure 1A:
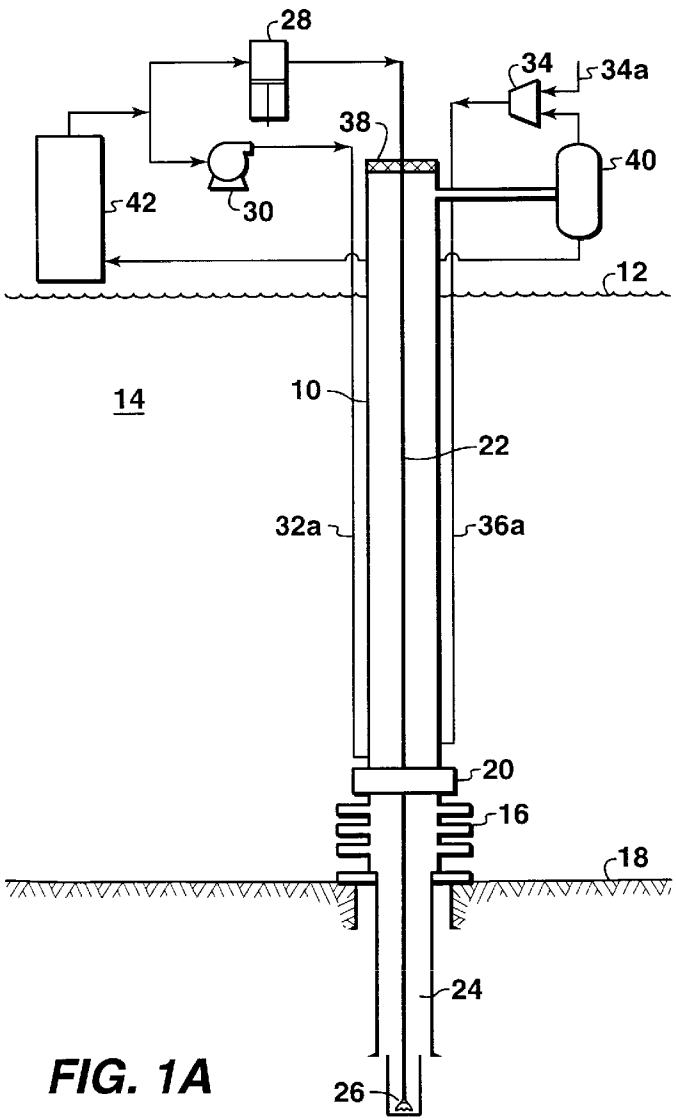

FIG. 1A provides a schematic overview of one form of a gas-lifted drilling system consisting of a conventional marine drilling riser 10 extending from a floating vessel or platform (not shown) at the surface 12 of body of water 14 to a blowout preventer (BOP) stack 16 located on the floor 18 of body of water 14. Typically, riser 10 is from about 16 to 24 inches (40.5 to 61 centimeters) in diameter and is made of steel. A lower marine riser package (LMRP) 20 is used to attach riser 10 to BOP stack 16. Typically, LMRP 20 also contains a flexible element or "flex joint" 95 (see FIG. 7A) to accommodate angular misalignment between riser 10 and BOP stack 16, connectors for various auxiliary fluid, electrical, and control lines, and, in many instances, one or more annular BOPs. As in conventional offshore drilling operations, a drill string 22 is suspended from a drilling derrick (not shown) located on the floating vessel or platform. The drill string 22 extends downwardly through drilling riser 10, LMRP 20, and BOP stack 16 and into borehole 24. A drill bit 26 is attached to the lower end of drill string 22. A conventional surface mud pump 28 pumps drilling mud down the interior of drill string 22, through nozzles in drill bit 26, and into borehole 24. The drilling mud returns to the subsea wellhead via the annular space between drill string 22 and the wall of borehole 24, and then to the surface through the annular space between drill string 22 and riser 10. Also included in a conventional offshore drilling system is a boost mud pump 30 for pumping additional drilling mud down a separate conduit or "boost mud line" 32*a* attached to riser 10 and injecting this drilling mud into the base of riser 10. This increases the velocity of the upward flow in riser 10 and helps to prevent settling of drill cuttings.

Modifications to the conventional drilling system to provide gas-lifting capability include a source (not shown) of lift gas (preferably, an inert gas such as nitrogen), a compressor 34 to increase the pressure of the lift gas, and a conduit or lift gas injection line 36*a* to convey the compressed lift gas to the base of riser 10 where it is injected into the stream of drilling mud and drill cuttings returning from the well. Any suitable source may be used to supply the required lift gas. For example, a conventional nitrogen membrane system may be used to separate nitrogen from the atmosphere for use as the lift gas. Lift gas from the lift gas source enters compressor 34 through source inlet line 34*a*. Following injection of the lift gas into the base of drilling riser 10, the mixture of drilling mud, drill cuttings, and lift gas circulates to the top of riser 10 where it is diverted from riser 10 by rotating diverter 38, a conventional device capable of sealing the annulus between the rotating drill string 22 and the riser 10. The mixture then flows to separator 40 (which may comprise a plurality of similar or different separation units) where the lift gas is separated from the drilling mud, drill cuttings, and any formation fluids that may have entered borehole 24. The separated lift gas is then routed back to compressor 34 for recirculation. Preferably, separator 40 is maintained at a pressure of several hundred psi to stabilize the multiphase flow in riser 10, reduce flow velocities in the surface components, and minimize compressor horsepower requirements. The mixture of drilling fluid and drill cuttings (and, possibly, formation fluids) is removed from separator 40, reduced to atmospheric pressure, and then routed to conventional drilling mud processing equipment 42 where the drill cuttings are removed and the drilling mud is reconditioned for recirculation into the drill string 22 or boost mud line 32*a*.

FIG. 1B illustrates an alternate gas-lift arrangement in which the return flow from the well is diverted from the drilling riser 10 into a separate mud return riser 44. If desired, a plurality of mud return risers may be used. A rotating diverter 46 located on top of BOP stack 16 serves to divert the drilling mud and drill cuttings into the mud return riser 44 and to separate the drilling mud in the well from the seawater with which the drilling riser 10 is filled. Lift gas and boost mud are injected into the base of mud return riser 44 through lift gas injection line 36*b* and boost mud line 32*b*, respectively. The mud return riser 44 may be attached to the drilling riser 10 or may be located more remotely from it. If the mud return riser 44 is located remotely, the boost mud line 32*b* and lift gas injection line 36*b* may be attached to the mud return riser 44 and the drilling riser 10 may be eliminated. The surface equipment for the FIG. 1B embodiment is the same as described above for FIG. 1A, except that a rotating diverter is not required at the top of the drilling riser or the mud return riser 44.

The following detailed description of the invention will be based primarily on the embodiment shown in FIG. 1A. However, the invention is equally applicable to the embodiment shown in FIG. 1B. Accordingly, the term "gas-lifted riser" will be used hereinafter to denote either a gas-lifted drilling riser in accordance with FIG. 1A or a separate gas-lifted mud return riser in accordance with FIG. 1B.

Figure 2:
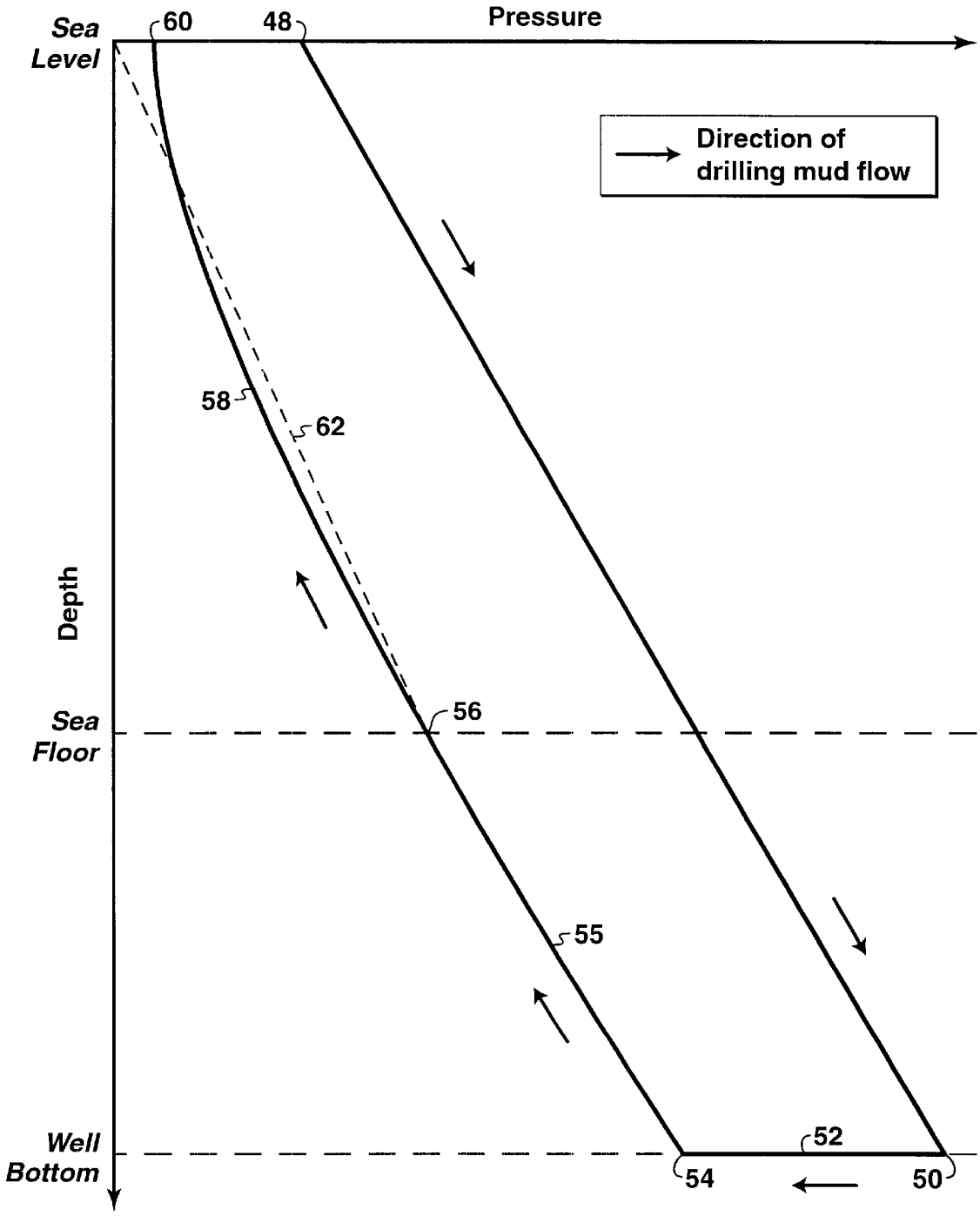
FIG. 2 illustrates the pressure relationships in various parts of a drilling mud circulation system when using a gas-lifted riser.

FIG. 2 illustrates the pressure relationships in various parts of the mud circulation system with a gas-lifted riser. Drilling mud is pumped into the system by the surface mud pump at the standpipe pressure 48. It increases in pressure as it circulates down the interior of the drill string by virtue of the hydrostatic pressure of the mud column above it (less the flowing frictional pressure drop in the drill string), until it reaches its maximum pressure 50 inside the drill bit. It undergoes a significant pressure drop 52 through the nozzles in the drill bit to the "bottom hole pressure" ($p_{bh}$) 54. Bottom hole pressure 54 (and the hydrostatic pressure throughout the open hole portion of the wellbore) must be controlled during the drilling operation to ensure that formation fluids do not enter the wellbore. From bottom hole pressure 54, the mud pressure decreases as the mud moves up the wellbore, following a gradient 55 determined largely by the density of the mud (including drill cuttings). As illustrated, when it reaches the elevation of the seafloor (i.e., the base of the riser), the pressure 56 of the mud (i.e., the riser base pressure or $p_{rb}$) is substantially the same as the ambient pressure of the surrounding seawater. In FIG. 2, the frictional pressure loss between the well and the base of a remote mud return riser (i.e., the FIG. 1B embodiment), if used, is ignored. At this point, lift gas is injected into the riser and the pressure of the mud-gas mixture follows curve 58 back to the surface where a positive surface pressure 60 (i.e., the riser surface pressure or $p_{rs}$) is maintained. The pressure gradient in the riser approximates that of seawater (represented by dashed line 62) and is different from the pressure gradient 55 in the wellbore; hence, this is a "dual density" system.

Pressure Control Principles

Figure 3:
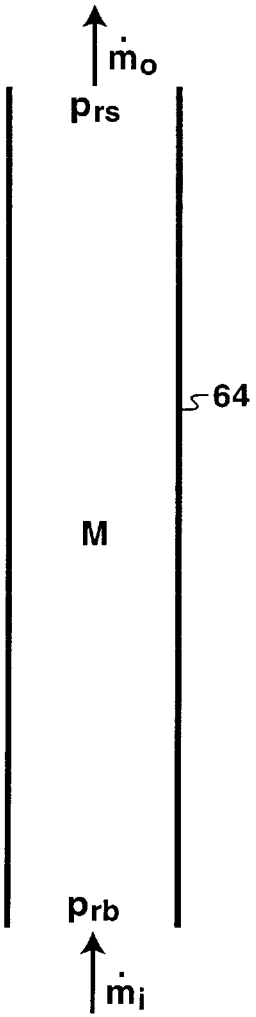
FIG. 3 schematically illustrates a vertical gas-lifted riser and the mass flows into and out of the riser.

FIG. 3 schematically illustrates a vertical gas-lifted riser 64, which may be either a drilling riser (the FIG. 1A embodiment) or a remote mud return riser (the FIG. 1B embodiment). The rate of total mass flow (drilling mud, formation fluids, drill cuttings, boost mud, and lift gas) into the base of riser 64 is denoted by $\dot{m}_i$. The internal pressure at the base of riser 64 is denoted by $p_{rb}$. Similarly, the mass flow rate out of the top of riser 64 is denoted by $\dot{m}_o$, and the pressure at the top of riser 64 is denoted by $p_{rs}$. The total mass of drilling mud, formation fluids, drill cuttings, boost mud, and lift gas inside riser 64 is denoted by M.

The objective of the pressure control system of the present invention is to maintain $p_{rb}$ approximately equal to the ambient seawater pressure at the base of the riser. As an example, without limiting the scope of the invention thereby, for a gas-lifted riser in 10,000 feet (3,048 meters) of water, the pressure control system preferably should be capable of maintaining $p_{rb}$ within about ±75 pounds per square inch (psi) (±517 kiloPascals (kPa)) of the ambient seawater pressure at the base of the riser, which is approximately 4450 psi (30,680 kPa). Preferably, pressure control is accomplished by using a dual-element strategy; however, in some situations either element alone may be sufficient. The first element adjusts the pressure at the surface ($p_{rs}$) and the mass flow rate out of the top of the riser ($\dot{m}_o$) to compensate for changes in riser base pressure ($p_{rb}$) due to variations in the mass flow rate entering the riser ($\dot{m}_i$). The second element makes adjustments to either or both of the boost mud and lift gas flow rates to maintain a constant or nearly constant mass flow rate entering the riser ($\dot{m}_i$). This second element enhances the dynamic performance of the pressure control system during transient conditions (i.e., mud flow rate or density changes of a temporary rather than a permanent nature).

Typical drilling mud and lift gas flow rates in a gas-lifted drilling riser having an internal diameter of about 20 inches (50.8 centimeters) are 100 to 1600 gallons per minute (gpm) (379 to 6056 liters per minute (lpm)) drilling mud and 5 to 40 million standard cubic feet per day (Mscfd) (0.142 to 1.132 million standard cubic meters per day (Mscmd)) lift gas. Simulations of these typical drilling mud and lift gas flows have indicated that the frictional pressure drop within the riser is small and can be neglected. Therefore, the riser base pressure, in the absence of large fluid accelerations, can be represented as:

$$p_{rb}=gM/A+p_{rs}, \tag{1}$$

where A is the internal cross-sectional area of the riser and g is the conversion factor from mass to weight and is defined as the ratio of local gravitational constant to the standard value at sea level and 45° latitude.

Once a gas-lifted riser has stabilized at the desired value of $p_{rb}$, the objective of the pressure control system is to maintain that pressure substantially constant (i.e., within the target pressure tolerance range), despite the transient events encountered in normal drilling operations. The necessary conditions to maintain a constant value of $p_{rb}$ can be represented mathematically by setting the differential form of equation (1) equal to zero:

$$dp_{rb}=(g/A)dM+dp_{rs}=0. \tag{2}$$

The term dM can also be represented as the difference between the mass flow into the riser and the mass flow out of the riser over a differential period of time, i.e., $(\dot{m}_i-\dot{m}_o)dt$. Substituting this expression into equation (2) yields:

$$(g/A)(\dot{m}_i-\dot{m}_o)dt+dp_{rs}=0. \tag{3}$$

Rearrangement of the terms of equation (3) results in:

$$\dot{m}_o dt-(A/g)dp_{rs}=\dot{m}_i dt. \tag{4}$$

Equation (4) illustrates that the riser base pressure ($p_{rb}$) will be constant (i.e., $dp_{rb}=0$) provided the mass flow out of the top of the riser ($\dot{m}_o dt$) and the pressure at the top of the riser ($p_{rs}$) are adjusted to compensate for changes in the mass flow into the bottom of the riser ($\dot{m}_i dt$). Fortunately, changes in $p_{rs}$ also produce changes in $\dot{m}_o$ that reinforce the desired behavior.

Figure 4:
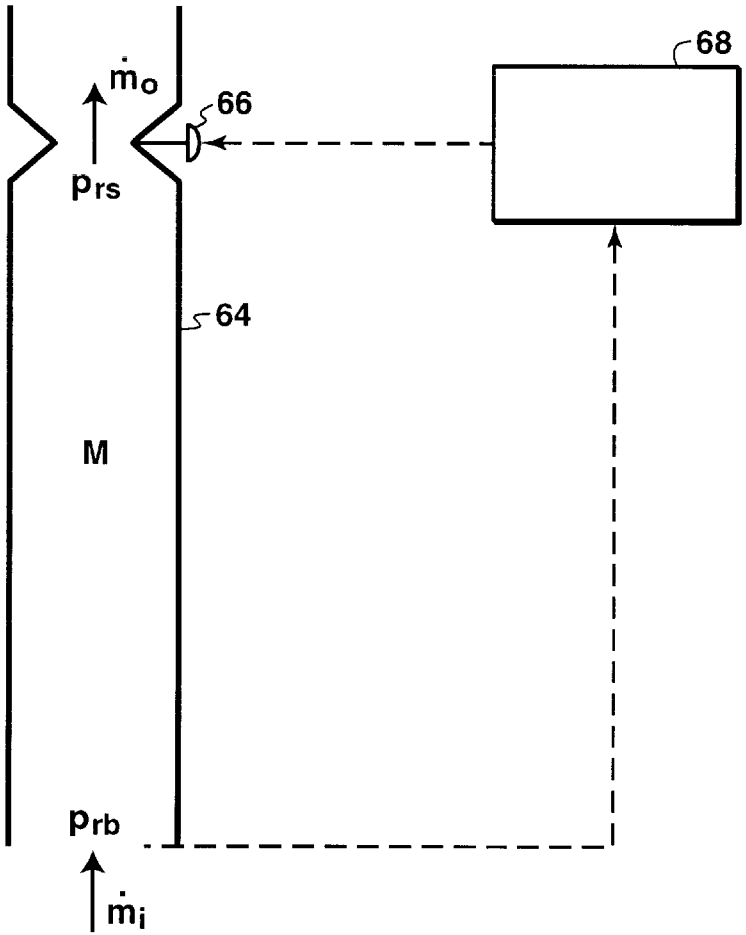
FIG. 4 schematically illustrates the first element of the pressure control system of the present invention.

FIG. 4 schematically illustrates the first element of the pressure control system. As noted above, in some cases the first element alone may provide an acceptable level of pressure control. In other cases, both elements of the preferred dual-element pressure control system may be required in order to obtain satisfactory pressure control. In FIG. 4, a throttling device, such as pressure control valve 66, installed at or near the outlet of riser 64 manipulates both the mass flow out of the top of the riser ($\dot{m}_o$) and the pressure at the top of the riser ($p_{rs}$) to maintain the riser base pressure ($p_{rb}$) at its desired value. If $p_{rb}$ decreases as a result of a decrease in $\dot{m}_i$ (e.g., a 2–5 minute reduction or cessation in flow from the well during a drill string connection), the pressure controller 68 will cause the pressure control valve 66 to close in order to increase $p_{rs}$ to compensate. The closure of pressure control valve 66 will also cause a decrease in $\dot{m}_o$ because it restricts flow out of riser 64. Conversely, if $\dot{m}_i$ increases (e.g., due to an increase in drill cuttings content in the drilling mud), pressure controller 68 will cause pressure control valve 66 to open in order to increase $\dot{m}_o$ and decrease $dp_{rs}$ to compensate. Therefore, the control system of FIG. 4 properly adjusts both terms to the left of the equality sign of equation (4) to compensate for changes in $\dot{m}_i$.

The simple control loop of FIG. 4 has practical limitations, especially when it comes to acceptable dynamic response to rapid transients or longer duration changes in $\dot{m}_i$. The second element of the preferred dual-element pressure control system addresses these limitations by minimizing disturbances to $\dot{m}_i$.

Figure 5:
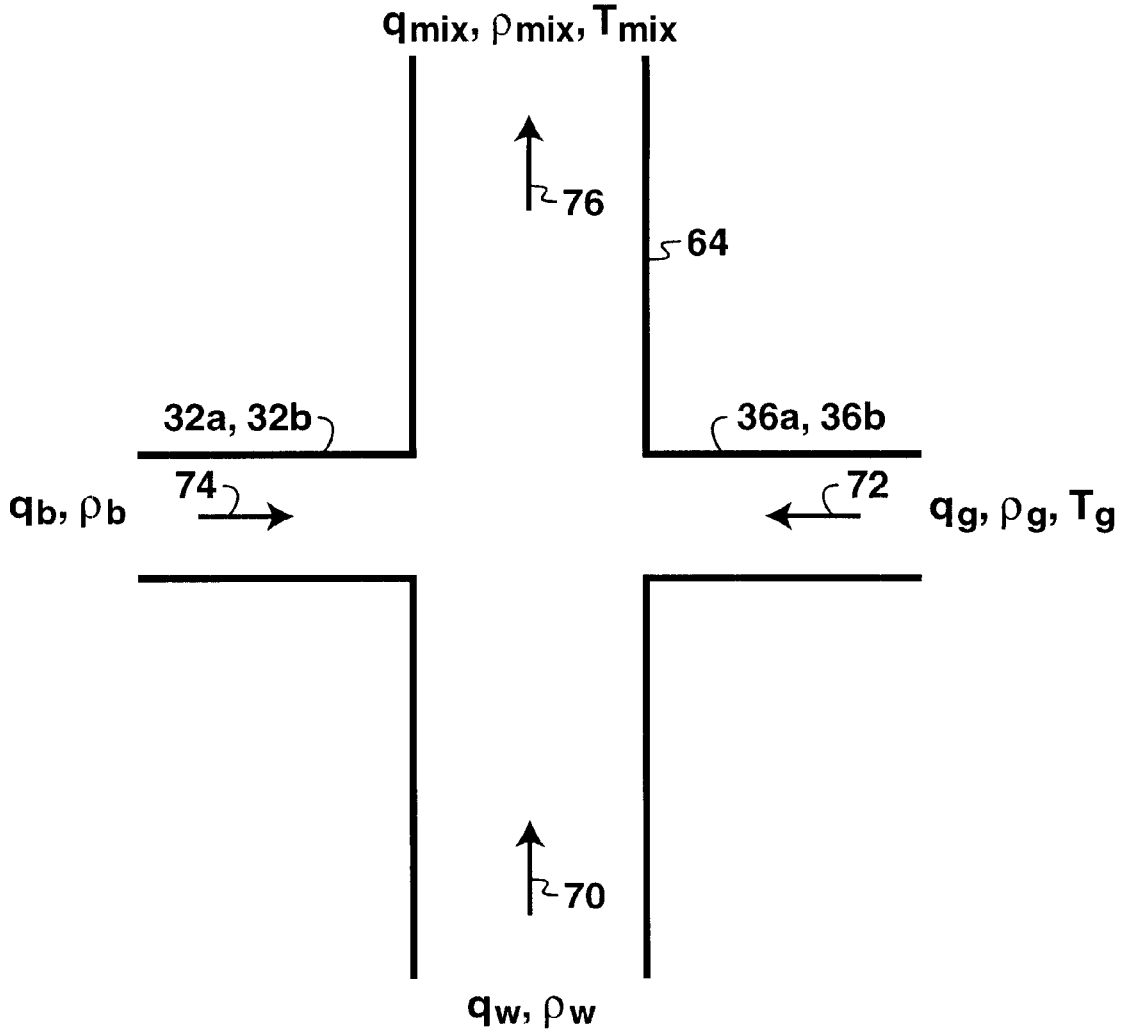
FIG. 5 schematically illustrates the flow conditions at the base of a gas-lifted riser.

FIG. 5 schematically illustrates the flow conditions at the base of a gas-lifted riser 64 where boost mud and lift gas are injected. Three flow streams combine at this point: the return flow from the well 70; the flow of injected lift gas 72; and the boost mud flow 74. The return flow from the well 70 includes drilling mud, drill cuttings, and any formation fluids that may have entered into the wellbore. The volumetric return flow rate from the well is represented by $q_w$ and its density by $\rho_w$ Lift gas of density $\rho_g$ and absolute temperature $T_g$ is injected into the riser at a flow rate of $q_g$. Boost mud of density $\rho_b$ is injected at a flow rate of $q_b$. The volumetric flow rate of the mixture 76 in riser 64 above (i.e., downstream of) the confluence is $q_{mix}$, its density is $\rho_{mix}$, and its absolute temperature is $T_{mix}$.

The mass flow rate of lift gas into the base of riser 64 can be expressed as $\rho_g q_g$, where both parameters are evaluated at the pressure and temperature of the lift gas at the point of injection. Similarly, the mass flow rate of the return flow from the well can be expressed as $\rho_w q_w$, and the mass flow rate of boost mud can be expressed as $\rho_b q_b$. Therefore, the mass flow rate into the base of riser 64 can be expressed as:

$$\dot{m}_i=\rho_w q_w+\rho_b q_b+\rho_g q_g. \tag{5}$$

In principle, either or both of the mass flow rates of boost mud ($\rho_b q_b$) and lift gas ($\rho_g q_g$) can be used to compensate for changes in $\dot{m}_i$ caused by unavoidable changes in $q_w$ and/or $\rho_w$ during normal drilling operations. However, since the density of the boost mud is, significantly greater than that of the lift gas, it provides a greater control range and, therefore, is preferred. Accordingly, in a preferred embodiment of the pressure control system, the lift gas flow rate is maintained constant during transient events and the boost mud flow rate ($q_b$) is adjusted, to compensate for changes in $q_w$ and $\rho_w$. Nevertheless, adjustment of the lift gas flow rate ($q_g$) to compensate for transient changes in $q_w$ and/or $\rho_w$ is within the scope of the present invention.

The necessary conditions for maintaining $\dot{m}_i$ constant can be determined by setting the differential form of equation (5) equal to zero:

$$d\dot{m}_i=0=\rho_w dq_w+q_w d\rho_w+\rho_b dq_b+q_b d\rho_b+\rho_g dq_g+q_g d\rho_g. \tag{6a}$$

By also holding constant the boost mud density ($d\rho_b=0$), lift gas density ($d\rho_g=0$), and lift gas flow rate ($dq_g=0$), the last three terms in equation (6a) drop out. Rearranging the remaining terms yields:

$$dq_b=-(\rho_w/\rho_b)dq_w-(q_w/\rho_b)d\rho_w. \tag{6b}$$

Equation (6b) demonstrates that, for a constant mass flow of lift gas (i.e., $dq_g=0$), it is theoretically possible to maintain a constant value of $\dot{m}_i$ by varying the boost mud flow rate $q_b$ to compensate for changes in $q_w$ and $\rho_w$, provided these parameters are known.

It will be shown below that it is practical to measure all of the variables on the right side of equation (6b) except the return flow rate from the well ($q_w$). Even if the gas-lifted riser in question is a separate mud return riser (the FIG. 1B embodiment), it is very difficult to measure $q_w$ accurately and reliably because of the wide range of types of drilling muds that may be used and the range of sizes and types of solid materials being carried in the return flow stream. If the gas-lifted riser in question is a drilling riser (the FIG. 1A embodiment), it is even more difficult to measure $q_w$ accurately and reliably because of the presence of the drill string within the drilling riser. However, as described below, it is possible to use known variables to solve for $q_w$.

Two equations can be written relating the flow downstream of the confluence of the three input flows to the variables defining those flows (see FIG. 5). The first is a statement of the conservation of mass:

$$\rho_{mix}q_{mix}=\rho_w q_w+\rho_b q_b+\rho_g q_g. \tag{7}$$

Equation (7) is a restatement of equation (5) where $\dot{m}_i$ is replaced with $\rho_{mix}q_{mix}$. This replacement is precisely correct only if there is no slip (i.e., difference in velocity) between the gas and liquid phases in the riser mixture. While not precisely correct, this is a reasonable approximation that has been shown to introduce negligible error and, therefore, will be made throughout the following derivation.

The second equation relates the volumetric flow rate of the riser mixture ($q_{mix}$) to the flow rates of the three input streams:

$$q_{mix}=q_w+q_b+[T_{mix}/T_g]q_g. \tag{8}$$

In addition to the assumption of no slip between phases, equation (8) incorporates the assumptions that the drilling mud and lift gas are immiscible and that the volumes of the liquid input streams ($q_w$ and $q_b$) do not change significantly due to changes in pressure and temperature from just upstream of the confluence (i.e., in their respective branches) to the point in the riser where $q_{mix}$ is computed. Provided that $q_{mix}$ is computed at an elevation not excessively above the confluence and that there are no severe flow restrictions, there will be little pressure change. There may be temperature changes, particularly for the boost mud stream, but the volumetric error for liquids will be small (on the order of 2%). Similarly, the effect of pressure changes on lift gas density can be neglected; however, the effect of temperature changes on lift gas density will be significantly greater. The injected lift gas will likely be at or near the ambient seawater temperature of about 35° F. (1.7° C.). The mud returning from the well may be about 150° F. (65.6° C.). The resulting increase in the volume of the lift gas may be as high as 20 to 30%. This is judged to be too great to ignore, so a temperature correction for $q_g$ is included in equation (8). A more exact correction would include the compressibility factors for the lift gas, but the error from omitting these factors is believed to be negligible. Persons skilled in the art could easily modify equation (8) to include a correction for the compressibility of the lift gas, as well as corrections for the pressure and temperature effects on the liquid input streams, if desired.

Combining equations (7) and (8) and solving for $q_w$, the return flow from the well, yields:

$$q_w=Aq_g-Bq_b \tag{9}$$

where $A=([T_{mix}/T_g]\rho_{mix}-\rho_g)/(\rho_w-\rho_{mix})$ and $B=(\rho_b-\rho_{mix})/(\rho_w-\rho_{mix})$. Equation (9) demonstrates that it is possible to calculate the return flow from the well ($q_w$) based on known and/or measurable quantities. This permits solution of equation (6b), and determination of the amount of boost mud flow ($q_b$) required to maintain a constant value of $\dot{m}_i$.

Figure 6:
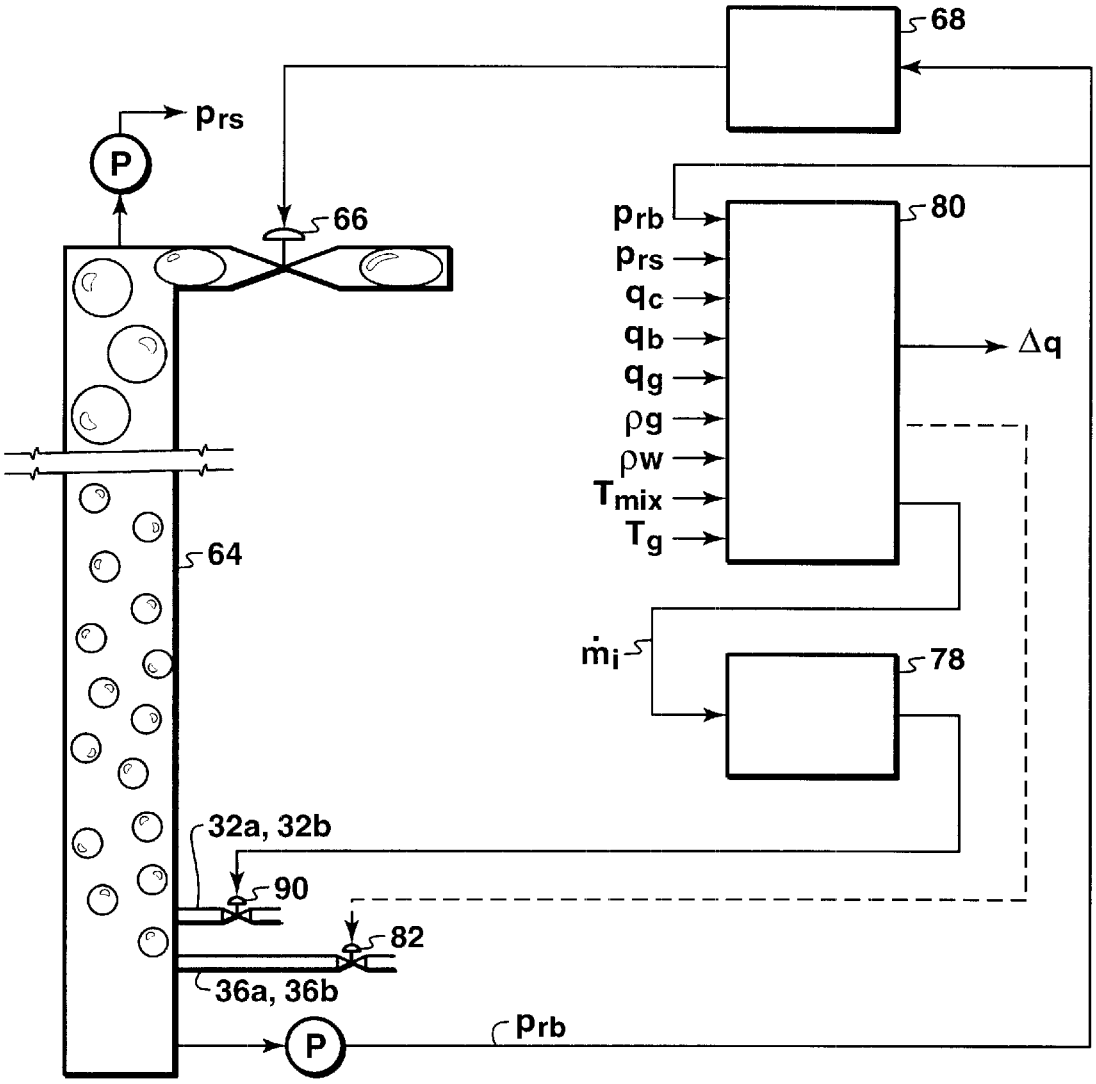
FIG. 6 schematically illustrates one embodiment of the dual-element pressure control system of the present invention.

FIG. 6 schematically illustrates one embodiment of the dual-element riser base pressure control system of the present invention. As discussed above in connection with FIG. 4, a pressure controller 68 adjusts the riser surface pressure ($p_{rs}$) and mass flow rate out of the top of the riser ($\dot{m}_o$) in response to deviations in the riser base pressure ($p_{rb}$) from its desired value. A throttling device, such as pressure control valve 66, is used to adjust $p_{rs}$ and $\dot{m}_o$. The second element of the control system makes adjustments to the boost mud flow rate ($q_b$) to maintain a nearly constant mass flow rate entering the base of the riser ($\dot{m}_i$). The boost mud flow is controlled by a boost mud flow controller 78 to maintain a constant value of mi based on the equations described above. Computations to derive the $q_b$ control signal are performed by a gas lift computer 80. Inputs to the gas lift computer 80 preferably include riser base pressure ($p_{rb}$), riser surface pressure ($p_{rs}$), drill string flow rate ($q_c$), boost mud flow rate ($q_b$), lift gas flow rate ($q_g$), lift gas density ($\rho_g$), well return density ($\rho_w$) riser mix absolute temperature ($T_{mix}$), and lift gas absolute temperature ($T_g$). Based on these inputs, the gas lift computer 80 computes the return flow rate from the well ($q_w$) according to equation (9) and $\dot{m}_i$ according to equation (5). Preferably, these computations are performed on a substantially continuous or frequently recurring basis throughout the gas lifting operation. The value of $\dot{m}_i$ is provided to the boost mud controller 78 which compares it to the desired value and makes the necessary adjustment in $q_b$ via a boost mud control valve 90. Control of $q_b$ may be near the injection point as illustrated in FIG. 6, in order to maintain $\dot{m}_i$ virtually constant, or control may be more remote from the injection point (and, accordingly, less precise), thereby increasing dependence on the surface pressure control. Also shown in FIG. 6 is a flow control valve 82 for adjusting the lift gas injection rate ($q_g$) in response to a signal (dashed line) from gas lift computer 80.

The preferred dual-element control scheme applies primarily to control of the riser base pressure ($p_{rb}$) during transient perturbations that are followed by a return to the circulating conditions that existed prior to the perturbation. An example would be a temporary interruption of circulation to add a length of drill pipe followed by a return to the original circulation rate. For these transient perturbations, it is preferable to maintain a constant flow of lift gas and vary only $p_{rs}$, $\dot{m}_o$, and $q_b$. Other perturbations will occur resulting from more "permanent" changes in circulating conditions. These include, for example, changes in the flow rate ($q_c$) and/or density ($\rho_c$) of the drilling mud circulated into the well through the drill string or changes in drilling rate that result in changes in well return density ($\rho_w$). The control system described above will attempt to maintain a constant riser base pressure ($p_{rb}$) and may succeed if the permanent changes are not excessive. However, since the preferred control system is not designed to change the lift gas flow rate ($q_g$), the values of $q_b$ and/or $p_{rs}$ following a permanent change in circulating conditions will likely be at or near the limits of their control ranges, leaving little or no range for further control. Under these conditions, it may be desirable to adjust $q_g$ so as to re-establish $q_b$ and $p_{rs}$ at their desired base or steady-state values. Several approaches are possible:

- $q_g$ can be adjusted manually to a value appropriate for the new circulating conditions. This can be accomplished gradually while allowing the automatic control system to maintain $p_{rb}$. A multiphase flow algorithm, look-up table, or other means of estimating the appropriate value of $q_g$ may be incorporated into the gas lift computer 80 (FIG. 6) for this purpose.
- $q_g$ can be adjusted automatically based on long-term averaging of measured circulating conditions ($q_c$, $\rho_c$, and/or $\rho_w$). Ideally, the flow interruptions due to connections would be excluded from the averaging process. Adjustments based on long-term averages will be inherently gradual. As with the manual adjustment approach, a multiphase flow algorithm, look-up table, or other means of estimating the appropriate value of $q_g$ may be incorporated into the gas lift computer 80.
- $q_g$ can be adjusted automatically based on long-term averages or trends in $q_b$ and $p_{rs}$ (or their related control valve positions) to maintain these parameters in their desired operating ranges. The averaging process must effectively ignore the short-term variations in these parameters as they respond to transient perturbations in $q_w$ and $\rho_w$. The averaging process would be incorporated into the gas lift computer 80.

It is likely that, even with automatic adjustments, some form of manual adjustment may be needed to optimize steady-state gas-lifting conditions.

As noted above, the most sensitive means of detecting kicks or lost circulation is by measuring the return flow of drilling mud from the well ($q_w$) and comparing it with the flow being pumped down the drill sting ($q_c$). The difference or "delta flow" ($\Delta q$) between these flow rates provides the earliest indication of flow of formation fluids into the well or flow of drilling mud from the well into the formation.

Attempts to measure return mud flow from the well above the point of injection of lift gas and/or boost mud will be seriously affected by these additional flows. However, as illustrated by equation (9) above, it is possible to calculate the return flow from the well ($q_w$) below the injection point. Consequently, the delta flow can be determined from the following equation:

$$\Delta q = q_w - q_c = \Delta q_g - B q_b - q_c, \tag{10}$$

where the factors A and B are as defined previously. Preferably, the gas lift computer 80 computes $\Delta q$ on a substantially continuous or frequently recurring basis according to equation (10). Equation (10) illustrates the importance to the accurate determination of $\Delta q$ of the measurement or other determination of the flow rates $q_g$, $q_b$, and $q_c$, as well as the densities and temperatures required to determine factors A and B. These parameters are also critical to the control of riser base pressure ($p_{rb}$).

Pressure Control of a Gas-lifted Drilling Riser

While the embodiment illustrated in FIG. 1B is a feasible approach to gas lifting of drilling returns, the embodiment illustrated in FIG. 1A is preferred since it offers the advantage of being most readily adaptable to existing drilling risers. The FIG. 1A embodiment also allows reversion to conventional drilling, if desired or if necessary as a result of a failure of the gas lift system.

Figure 7A:
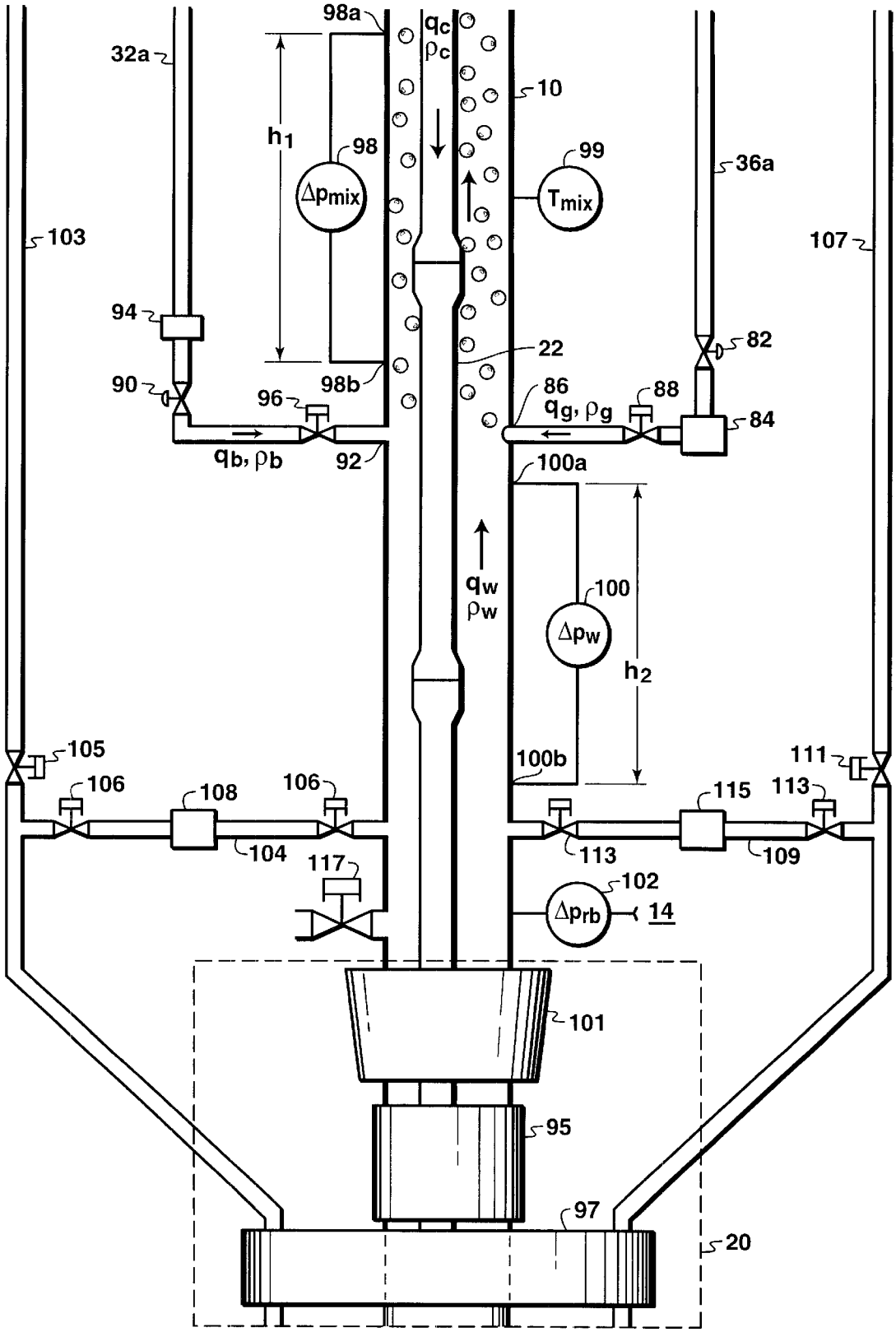
FIG. 7A illustrates one possible arrangement of the control system components at the base of a gas-lifted drilling riser according to the present invention.

FIG. 7A illustrates one possible arrangement of the control system components at the base of a gas-lifted drilling riser 10. A string of drill pipe 22 is shown inside drilling riser 10. The volumetric flow rate of drilling mud circulating into the well through the drill pipe is $q_c$ and its density is $\rho_c$. As in conventional drilling operations, these quantities are measured by instruments at the surface (not shown). The return flow rate from the well in the annulus between the drill pipe and the riser is $q_w$ and its density is $\rho_w$. Under normal drilling conditions (i.e., in the absence of a kick or lost circulation), $q_w$ equals $q_c$ and $\rho_w$ will be somewhat greater than $\rho_c$ owing to suspended drill cuttings.

Compressed lift gas flows down the gas injection line 36*a* and enters the riser 10 through lift gas flow control valve 82 and lift gas flow meter 84. Lift gas flow control valve 82 is operated by the control system to regulate the lift gas flow rate ($q_g$), which is measured locally by lift gas flow meter 84. The density $\rho_g$ of the lift gas at the injection point 86 is computed by the gas lift computer (see FIG. 6) based on its pressure and temperature which will be essentially those of the ambient seawater at the injection point. Although only one injection point 86 is illustrated, several injection ports spaced around the circumference of riser 10 would probably be used to promote rapid mixing of the lift gas into the drilling mud flow stream. Lift gas flow control valve 82 and lift gas flow meter 84 are preferably located at the base of riser 10 for optimal response to flow controller set point changes; however, these devices could be located at the surface if response delays due to line pack (i.e., the time required for pressure and/or flow volume changes at one end of a pipeline to reach the other end) are acceptable. Also shown in FIG. 7A is an optional lift gas injection isolation valve 88 which is controlled from the surface and may be used to shut down the lift gas injection process and return to conventional drilling.

The stream of boost mud from boost mud line 32*a* is regulated by the control system via the boost mud flow control valve 90. For convenience in maintaining the instruments, the boost mud flow rate ($q_b$) and boost mud density ($\rho_b$) are preferably measured at the surface, but could be measured at the base of riser 10, if desired. Generally, $\rho_b$ will equal $\rho_c$. The hydrostatic pressure of the column of mud in boost mud line 32*a* will be greater than the pressure in riser 10 at boost mud injection point 92. For example, in 10,000 feet (3,048 meters) of water with a drilling mud having a density of 18 pounds per gallon (2.157 kilograms per liter), the hydrostatic pressure of the column of mud in boost mud line 32*a* will be nearly 5,000 psi (34,475 kPa) greater than the pressure inside riser 10 (assuming that gas-lifting is in progress). To protect boost mud flow control valve 90 from being required to operate at very high differential pressures, a variable choke 94 (or, alternatively, a manifold of selectable fixed chokes) may be installed upstream of the boost mud flow control valve 90. Variable choke 94, which can be controlled from the surface, will be set to drop the majority of the pressure differential, while still permitting boost mud flow control valve 90 to control $q_b$ within the desired range. An optional boost mud injection isolation valve 96, which is controlled from the surface, may be used to shut down the boost mud injection process and return to conventional drilling.

FIG. 7A also shows a differential pressure device 98 for measuring the differential pressure ($\Delta p_{mix}$) of the gas/mud mixture between two points 98*a* and 98*b* in riser 10 separated by a distance $h_1$. This device is located a sufficient distance above the lift gas and boost mud injection points 86 and 92, respectively, so that full mixing of the flow streams will have occurred. The differential pressure ($\Delta p_{mix}$) can be used to calculate the effective density of the gas/mud mixture ($\rho_{mix}$). The distance $h_1$ between points 98*a* and 98*b* should be large enough to result in an easily measurable pressure differential and may, for example, be from about 10 to 30 feet (about 3 to 9 meters). In the same region of riser 10 is a temperature sensor 99 for measuring the temperature of the mud/gas mixture ($T_{mix}$). A second differential pressure device 100 is shown below the lift gas and boost mud injection points (i.e., in the portion of riser 10 containing only the return flow from the well) to measure the differential pressure ($\Delta p_w$) and, therefore, the density ($\rho_w$) of the well return flow stream between two points 100*a* and 100*b* in riser 10 separated by a distance $h_2$ (which may be the same as or different from distance $h_1$). A third device 102 for measuring the riser base pressure ($p_{rb}$) is shown as a differential pressure instrument ($\Delta p_{rb}$) connected between the base of riser 10 and the ambient seawater 14. Alternatively, a high-resolution pressure transducer could be connected to the base of riser 10 to directly measure $p_{rb}$.

Lower marine riser package 20 includes an annular stripper 101, which is a device capable of sealing the riser annulus around drill string 22 (or around a length of well casing being installed into the well). The annular stripper 101 (which may be a conventional or modified annular BOP) is designed to permit the drill string or casing to be raised or lowered (i.e., stripped) through it while maintaining a low pressure seal. Also shown inside LMRP 20 are a riser flex joint 95 for accommodating angular misalignments of riser 10 with respect to BOP stack 16 (see FIGS. 1A and 1B) and a lower riser connector 97 for connecting LMRP 20 to BOP stack 16.

Figure 7B:
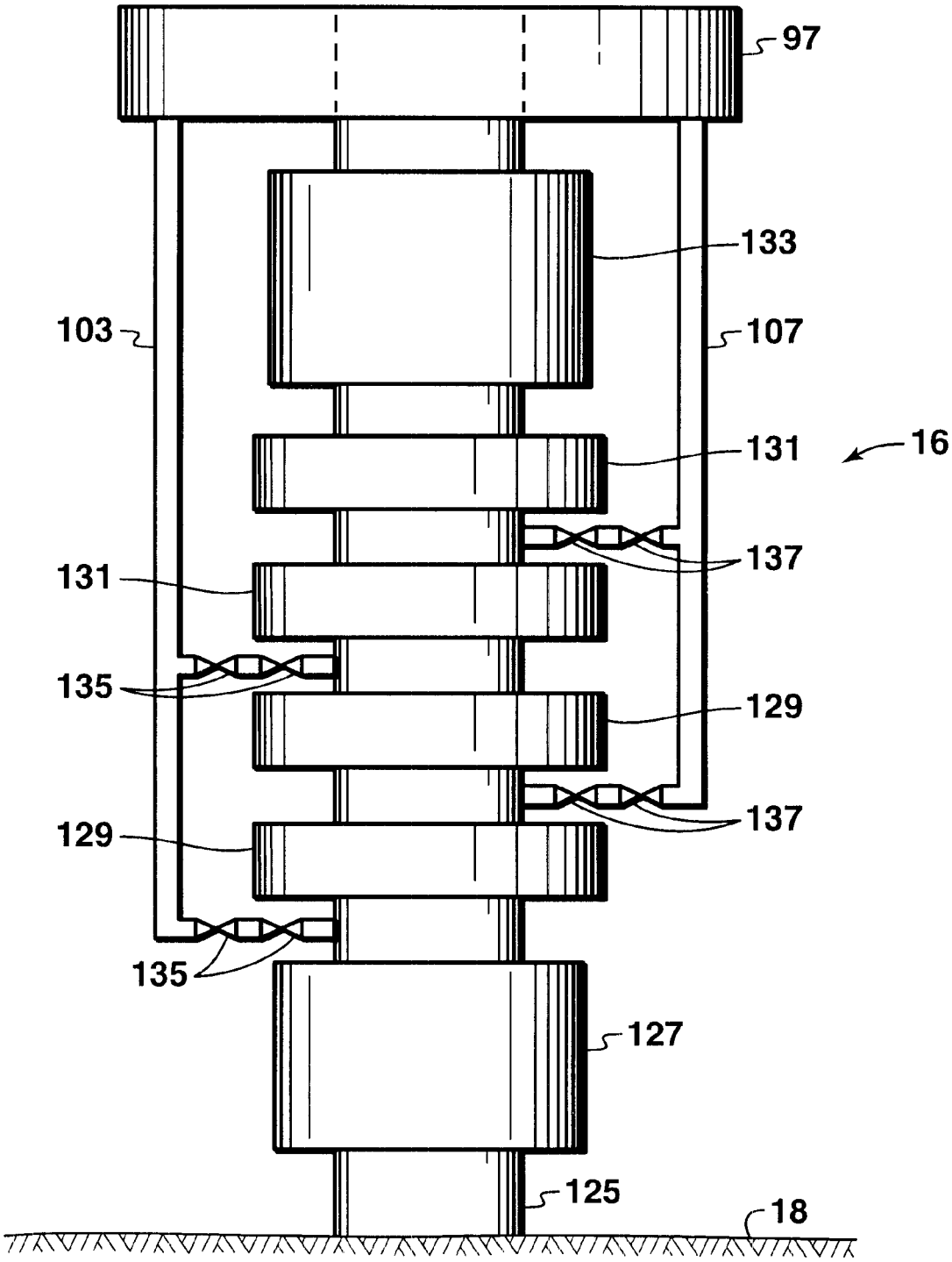
FIG. 7B illustrates a conventional subsea blowout preventer (BOP) stack and associated kill and choke lines.

FIG. 7B illustrates a conventional BOP stack 16 which is connected to well surface casing 125 by wellhead connector 127. Typically, BOP stack 16 includes one or more pipe rams 129 (two shown), one or more shear rams 131 (two shown), and one or more annular BOPs 133 (one shown).

Referring now to FIGS. 7A and 7B, a conventional kill line 103 extends downwardly from the surface of the body of water, passes through lower riser connector 97, and connects to the body of the BOP stack 16 at several locations via kill side outlet valves 135. A bypass flow line 104 connects kill line 103 below kill line isolation valve 105 with riser 10 above the annular stripper 101. Bypass flow line 104 contains one or more bypass isolation valves 106 (two shown) operable from the surface of the body of water and a bidirectional bypass flow meter 108. When annular stripper 101 is closed, the kill line isolation valve 105 is closed, the bypass isolation valves 106 are opened, and the appropriate kill side outlet valves 135 (i.e., those below the closed BOP) are opened. Therefore, mud flow between borehole 24 and riser 10 will pass through bypass flow line 104 and bypass flow meter 108.

Similarly, a conventional choke line 107 extends downwardly from the surface of the body of water, passes through lower riser connector 97, and connects to the body of BOP stack 16 at several locations via choke side outlet valves 137. A subsea choke flow line 109 connects choke line 107 below choke line isolation valve 111 with riser 10 below the lower connection 100*b* of differential pressure device 100. Subsea choke flow line 109 contains one or more subsea choke isolation valves 113 (two shown) and a subsea choke 115 remotely operable from the floating vessel or platform. When one or more of the BOPs are closed, the choke line isolation valve 111 is closed, the subsea choke isolation valves 113 are opened, and the appropriate choke side outlet valves 137 (i.e., those below the closed BOP) are opened. Therefore, flow from borehole 24 will pass through subsea choke flow line 109 and subsea choke 115 to enter riser 10.

FIG. 7A also shows a seawater fill/dump valve 117 connecting riser 10 with the surrounding seawater. This valve is used as a safety valve in the event of a malfunction of the pressure control system or other circumstance requiring rapid restoration of the pressure inside riser 10 to the ambient seawater pressure.

The control system components illustrated in FIG. 7A could easily be adapted to the separate mud return riser embodiment (the FIG. 1B embodiment) of the invention. Basically, as described above, a rotating diverter 46 (see FIG. 1B) would be inserted below LMRP 20 and the mud return line 44 (see FIG. 1B) would be attached to the subsea wellhead below the rotating diverter. The boost mud line and the lift gas injection line, as well as their respective control components described above, and the three differential pressure devices would be attached to the base of the mud return riser rather than to the drilling riser. Similarly, the bypass flow line and the subsea choke flow line would be connected to the base of the mud return riser rather than to the drilling riser.

Preferred Pressure Control System

As noted above, the preferred method of controlling riser base pressure ($p_{rb}$) uses two complementary control elements, one to regulate $p_{rs}$ and $\dot{m}_o$, and another to limit variations in $\dot{m}_i$ by controlling $q_b$. Simulations of various methods for utilizing these two control elements have demonstrated that a number of options are feasible.

In general, control of the boost mud flow rate ($q_b$) governs the initial response to localized mass flow and/or density perturbations arising from operations such as short flow interruptions for a drill string connection, changes in cuttings load, kicks, or lost circulation. This control element provides for rapid pre-emptive adjustment of $q_b$ such that the short term and long term impact on the riser base pressure ($p_{rb}$) is minimized. Regulating $p_{rs}$ and $\dot{m}_o$ as a function of actual variations in the riser base pressure ($p_{rb}$), on the other hand, provides an effective feedback control mechanism that compensates for any errors in the control of $\dot{m}_i$. This control element is especially effective in dealing with the delayed effects of riser base pressure perturbations as the gas/mud mixture propagates to the top of the riser. Consequently, if the boost mud controller is able to keep $\dot{m}_i$ nearly constant, there will be less need for a wide range of pressure control at the surface. If $\dot{m}_i$ is allowed to vary more, a wider range of surface control will be needed. It is therefore possible to make trade-offs on the quality of boost mud flow control versus regulation of surface pressure while maintaining acceptable control of riser base pressure ($p_{rb}$).

The currently preferred embodiment of the invention places emphasis on using $q_b$ to compensate for changes in $q_w$ and/or $\rho_w$ as illustrated by equation (6b). Adjustment of the riser surface pressure ($p_{rs}$) and flow rate out of the top of the riser ($\dot{m}_o$) is used to compensate for the relatively small errors introduced by the boost mud control system.

As described above, equation (9) should be solved for $q_w$ on a substantially continuous or frequently recurring basis throughout the gas-lifting operation. In principle, this computed value of $q_w$ could then be used to solve for $\dot{m}_i$ using equation (5) and adjusting $q_b$ (and/or $q_g$) to keep $\dot{m}_i$ constant. However, a simpler approach is preferred that accomplishes essentially the same objective.

For the special case where $\rho_b=\rho_w$, equation (6b) becomes $$dq_b=-dq_w, \tag{11}$$

which is equivalent to holding the sum $q_w+q_b$ constant. Since the objective of controlling $q_b$ is to maintain a constant value of $\dot{m}_i$, and $\dot{m}_i$ can be expressed as the product $\rho_{mix}q_{mix}$ (assuming no slip between the liquid and gas phases), this objective will be realized if:

$$d\dot{m}_i=d(\rho_{mix}q_{mix})=\rho_{mix}dq_{mix}+q_{mix}d\rho_{mix}=0. \tag{12}$$

If the gas rate $q_g$ is constant and the sum $q_w+q_b$ is constant, $q_{mix}$ will be constant (provided $T_{mix}$ is also constant—see equation (8)) and $dq_{mix}=0$. Equation (12) then reduces to:

$$q_{mix}d\rho_{mix}=0. \tag{13}$$

Since $q_{mix}$ is non-zero, equation (13) indicates that the desired control can be achieved by holding $\rho_{mix}$ constant (i.e., $d\rho_{mix}=0$).

Several assumptions were made in arriving at equation (13) (i.e., $\rho_b=\rho_w$, no slip, constant $T_{mix}$) that generally will not be precisely correct.

However, these assumptions do not introduce significant errors under most conditions. Furthermore, the additional control of $p_{rb}$ afforded by regulating $p_{rs}$ and $\dot{m}_o$ (i.e., the first control element) will compensate for these errors.

Figure 8:
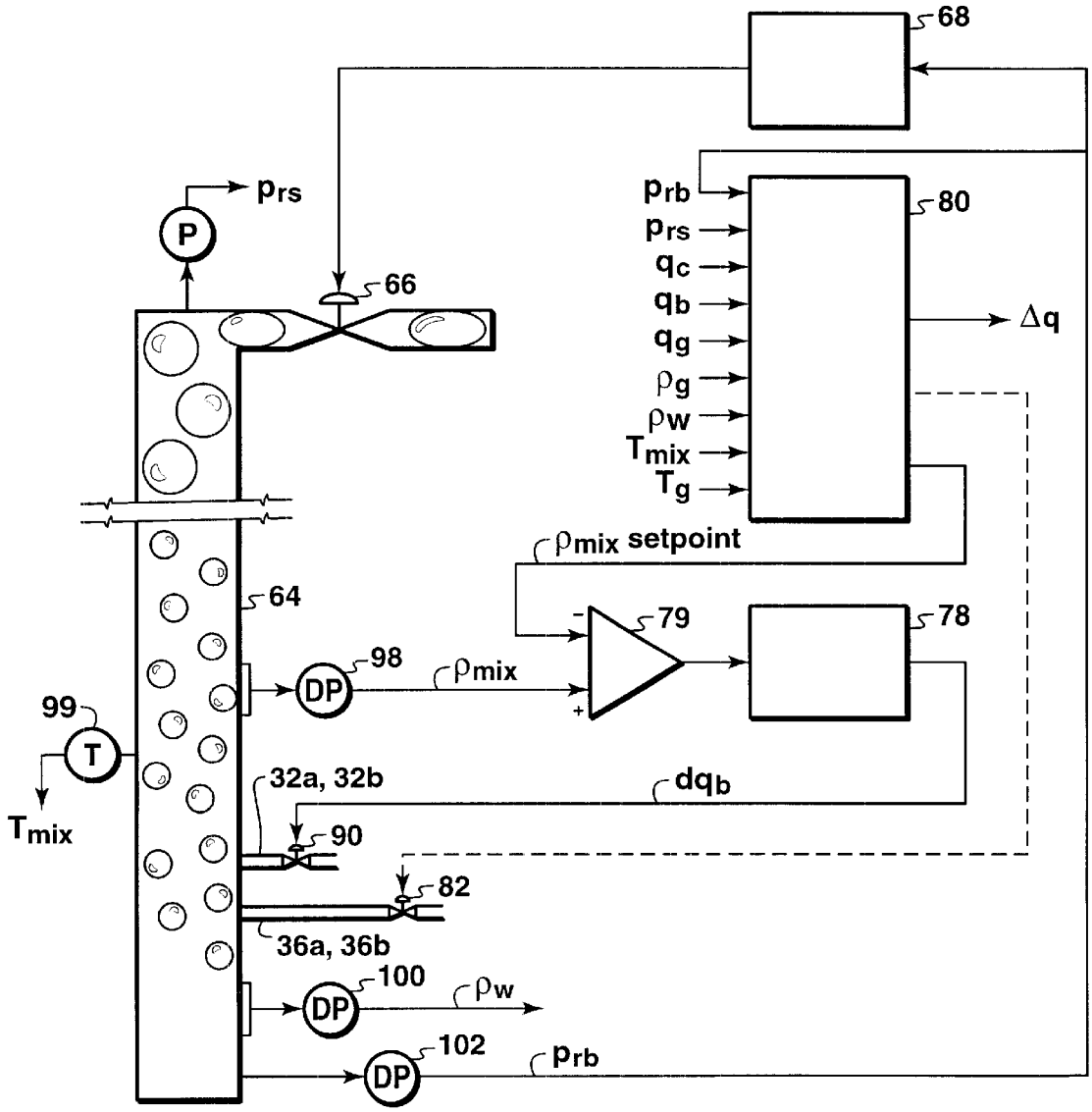
FIG. 8 illustrates an embodiment of the invention in which riser mix density ($p_{mix}$) is used to control the riser base pressure ($p_{rb}$)

FIG. 8 illustrates an embodiment of the present invention in which $\rho_{mix}$ is used to control $p_{rb}$. The control system seeks to maintain $\rho_{mix}$ equal to a setpoint value, determined either manually or by the gas lift computer 80, corresponding to the desired steady-state gas lifting conditions. As described above in connection with FIG. 7A, the actual value of $\rho_{mix}$ is measured by differential pressure device 98. Deviations of $\rho_{mix}$ from the setpoint value, as determined by comparator 79, cause the boost mud flow controller 78 to adjust $q_b$ to drive the error signal back to zero. Typically, the boost mud flow controller 78 will permit a base level of boost mud flow (e.g., 60 gpm (227 lpm)) under steady-state conditions. This will allow $q_b$ to be decreased as well as increased to compensate for deviations in $\rho_{mix}$. Transient conditions that could necessitate a reduction in $q_b$ include a well kick (i.e., an increase in $q_w$) or a temporary increase in the amount of drill cuttings in the mud (i.e., an increase in $\rho_w$) Transient conditions that would necessitate an increase in $q_b$ include a shutdown of the surface mud pumps to permit addition of a joint of drill pipe.

Similarly, in an alternate embodiment, adjustments to the lift gas flow rate ($q_g$) could be used either in place of or in addition to changes in $q_b$ to minimize deviations of $\rho_{mix}$ from the setpoint value. However, as noted above, due to its greater density and, accordingly, larger control range, adjusting the boost mud flow rate ($q_b$) is the preferred method for controlling $\rho_{mix}$.

Also shown in FIG. 8 is a pressure controller 68 that simultaneously regulates $p_{rs}$ and $\dot{m}_o$ via a pressure control valve 66 in the flow line between riser 64 and separator 40 (FIGS. 1A and 1B). Alternatively and preferably, pressure control valve 66 may be located in the gas flow line from the separator 40 to compressor 34 (FIGS. 1A and 1B) in order to protect it from the abrasive effects of the drilling mud and drill cuttings. Pressure control valve 66 is operated in response to deviations in $p_{rb}$ from the desired value. Preferably, the signal representing $p_{rb}$ is a differential pressure between the pressure inside the riser and the ambient seawater pressure so the desired value of this differential pressure will be zero regardless of the water depth. In response to an increase in $p_{rb}$, the pressure controller 68 will open the pressure control valve to lower $p_{rs}$ and increase $\dot{m}_o$. The action will be opposite in response to a decrease in $p_{rb}$.

FIG. 8 also shows a temperature sensor 99 for determining the riser mix absolute temperature ($T_{mix}$). This temperature is needed for the temperature correction in factor "A" of equation (9).

Instrumentation/Equipment

The pressure control system of the present invention requires appropriate instrumentation to measure a number of operating parameters of the gas-lifting system. Other operating parameters are calculated based on the measured parameters.

Measured parameters preferably include riser base pressure ($p_{rb}$), riser surface pressure ($p_{rs}$), drill string flow rate ($q_c$), drill string mud density ($\rho_c$), boost mud flow rate ($q_b$), boost mud density ($\rho_b$), lift gas flow rate ($q_g$), riser mix absolute temperature ($T_{mix}$), riser mix density ($\rho_{mix}$), and well return density ($\rho_w$). Lift gas absolute temperature ($T_g$)

and lift gas density ($\rho_g$) are preferably computed by gas lift computer 80 (FIGS. 6 and 8) based on the temperature and pressure of the ambient seawater at the base of the riser, but may be directly measured if desired. Based on these measured (and computed) parameters and the equations set forth above, the gas lift computer 80 calculates the well return flow rate ($q_w$), the riser mix flow rate ($q_{mix}$), and the delta flow ($\Delta q$), as well as the necessary adjustments to either or both of the boost mud flow rate ($q_b$) and the lift gas flow rate ($q_g$) needed to keep the riser base pressure ($p_{rb}$) within the desired control range. If desired, the gas lift computer 80 may also be used to calculate the mass flow rate out of the top of the riser ($\dot{m}_o$).

Standard, commercially-available instrumentation may be used for determining the measured parameters. Various types of flow meters are known in the industry to be suitable for measuring the drill string flow rate ($q_c$), boost mud flow rate ($q_b$), and lift gas flow rate ($q_g$). The flow meter for measuring lift gas flow rate ($q_g$) is preferably located near the base of the riser, and therefore, must be capable of reliable operation at the ambient seawater pressure. The riser mix absolute temperature ($T_{mix}$) and, if desired, the lift gas absolute temperature ($T_g$) may be determined with any suitable thermocouple, thermometer, or other temperature sensor which are capable of reliable operation at the ambient seawater pressure at the base of the riser. The drill string mud density ($\rho_c$) and boost mud density ($\rho_b$) are preferably measured by conventional instruments at the surface of the body of water. If desired, corrections for the effects of compressibility of these fluids may be made by the gas lift computer 80. As described above, riser mix density ($\rho_{mix}$) and well return density ($\rho_w$) are preferably computed based on differential pressure measurements in these flow streams (e.g., differential pressure devices 98 and 100 in FIG. 7A). The riser surface pressure ($p_{rs}$) may be measured by any suitable type of pressure transducer and, as described above, the riser base pressure ($p_{rb}$) may be measured either by an absolute pressure transducer or by a differential pressure transducer adapted to measure the pressure differential between the interior of the riser and the ambient seawater.

Pressure control valve 66 is preferably a commercially-available flow control valve. The other valves used in the preferred embodiment (e.g., lift gas flow control valve 82, lift gas injection isolation valve 88, boost mud flow control valve 90, boost mud injection isolation valve 96, bypass isolation valves 106, and subsea choke isolation valves 113) are preferably commercially-available valves which can be remotely-controlled from the surface and which are capable of reliable operation at the pressure and temperature conditions existing at the base of the riser.

Bi-directional bypass flow meter 108 must be capable of reliably determining the bypass flow rate regardless of the direction of flow in bypass flow line 104 and must be capable of operating at the ambient seawater pressure at the base of the riser. Since it is principally used to measure volumes of mud displaced from or into the well, it is preferably a positive displacement type of flow meter.

Subsea choke 115 preferably is a commercially available drilling choke adapted for remote operation in water depths greater than about 5,000 feet (1,524 meters). A suitable choke is disclosed in U.S. Pat. No. 4,046,191 issued Sep. 6, 1977 and entitled "Subsea Hydraulic Choke." Fill/dump valve 117 is a commercially available valve, conventionally used to either fill the drilling riser with seawater or to dump drilling mud to the sea in an emergency situation. It is remotely operated from the surface, either manually or automatically, in response to a situation in which $p_{rb}$ differs too greatly from the pressure of the surrounding seawater.

Lastly, gas lift computer 80 is preferably a commercially-available digital computer, and pressure controller 68 and boost mud controller 78 are preferably commercially-available control units capable of calculating the required control signals based on the specified inputs.

Simulations

The various simulations described herein were performed using a commercially available two-phase flow simulator known as OLGA, which is available from Scandpower Inc., having offices in Gaithersburg, Md. and Houston, Tex.

Figure 9A:
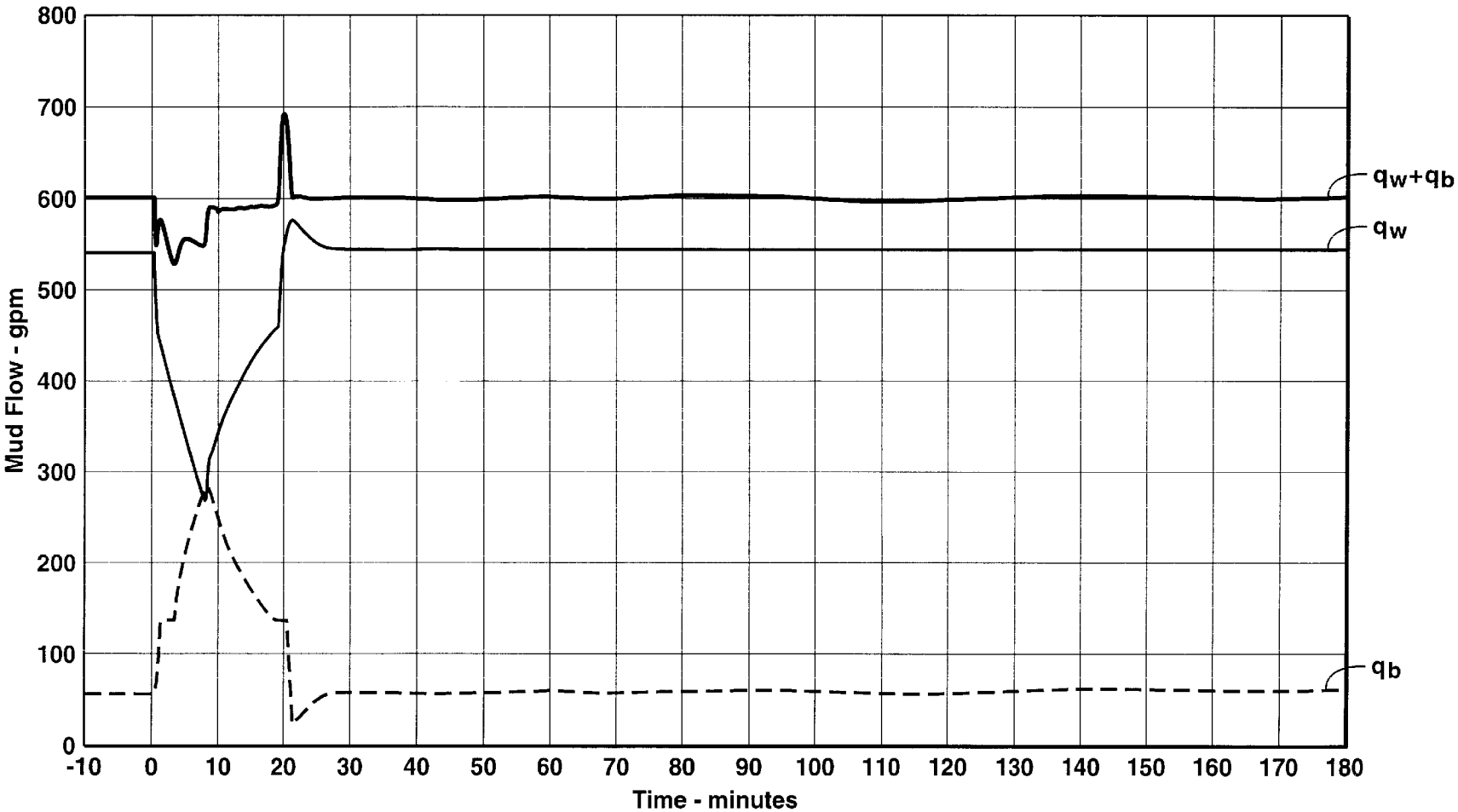
FIGS. 9A and 9B illustrate the results of a simulation of the response of the pressure control system to a transient event when only the second element (boost mud control) is used.
Figure 9B:
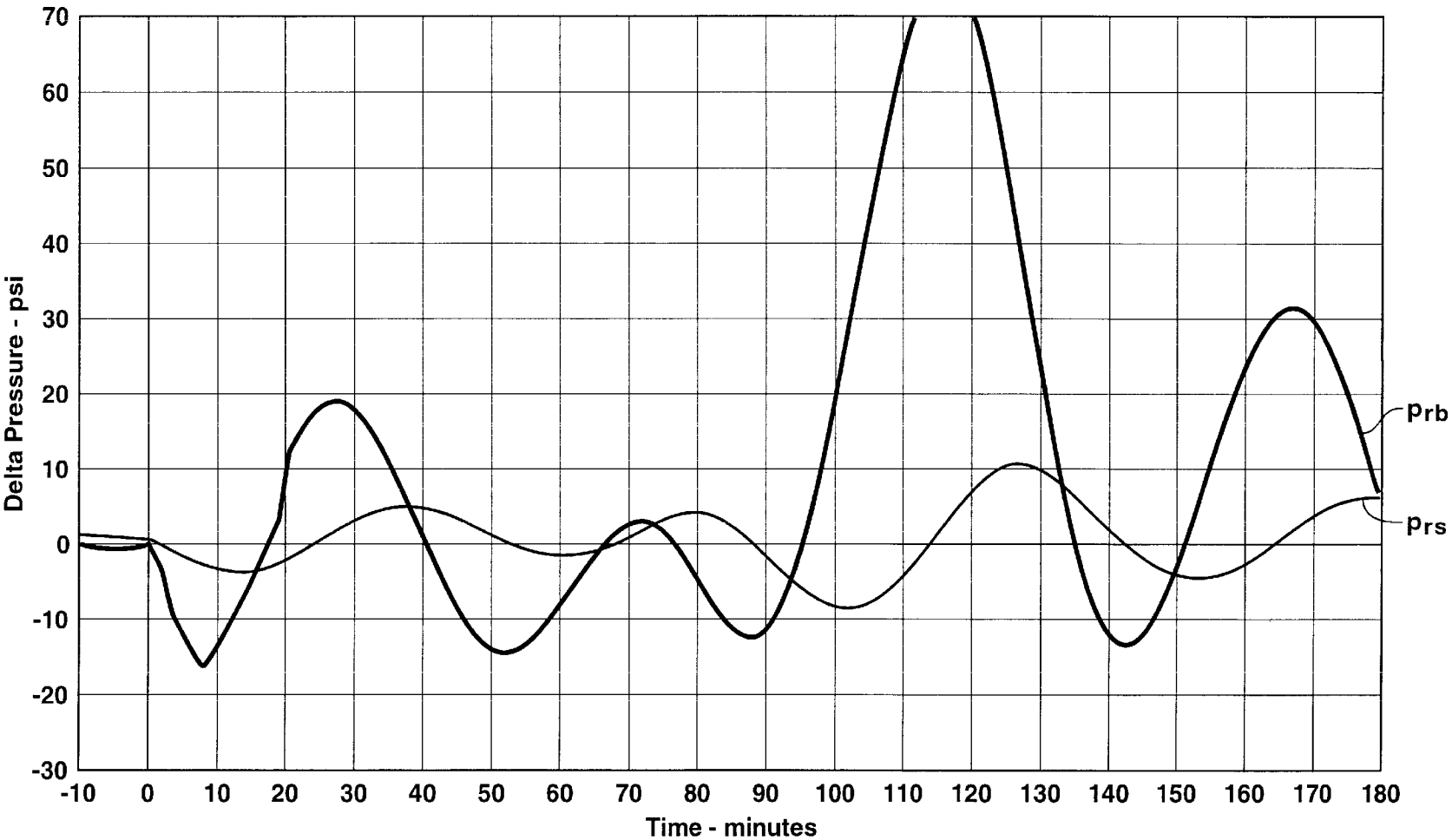

FIGS. 9A and 9B illustrate the results of a simulation of the pressure control system's response to a transient event when only boost mud control is used. The water depth was assumed to be 10,000 feet (3,048 meters). The simulated transient is a five-minute shutdown of the surface mud pumps to permit the connection of an additional length of drill pipe. Prior to the connection, $q_c$ and $q_w$ were 540 gpm (2044 lpm) and $q_b$ was 60 gpm (227 lpm) for a total liquid flow in the riser of 600 gpm (2271 lpm). Mud densities $\rho_c$, $\rho_b$, and $\rho_w$ were 16 pounds per gallon (ppg) (1.92 kilograms per liter (kg/liter)). Initially, $p_{rs}$ was 285 psi (1965 kPa), resulting from a separator pressure of 215 psi (1482 kPa) and a fixed orifice between the riser and the separator (simulating piping) that resulted in a 70 psi (483 kPa) pressure drop. The gas injection rate $q_g$ remained constant at 26 Mscfd (0.736 Mscmd), the rate calculated to be required to maintain $p_{rb}$ at 4451 psi (30,689 kPa), the approximate pressure of the surrounding seawater.

FIG. 9A shows the perturbation in the well return flow $q_w$ resulting from a five-minute shutdown and subsequent start-up of the mud pumps. It also shows the changes in the boost mud flow $q_b$ resulting from attempts by the boost mud flow controller to maintain $\rho_{mix}$ constant and the resulting total mud flow ($q_w$+$q_b$). The perturbations of total mud flow are significantly less than without boost mud control.

FIG. 9B shows the resulting value of riser base pressure ($p_{rb}$) during this transient event. Also shown is the riser surface pressure ($p_{rs}$). Both pressures are represented as differential or "delta" pressures relative to their original values.

The pump shutdown began at time equals zero minutes. Studies of dual density drilling systems have shown that when drilling with fluids more dense than seawater, $q_w$ will decay over a period of 10 to 20 minutes, rather than abruptly when the pumps are shut down due to the need for the fluid level in the drill pipe to fall to reach hydrostatic equilibrium with the less dense column in the drilling riser. Similarly, on restart of the mud pumps, $q_w$ will build up over several minutes due to compression of the column of air in the drill pipe. In this simulation, $q_w$ declined to 268 gpm (1015 lpm) before the restart of the mud pumps returned it to 540 gpm (2044 lpm). The boost mud flow controller caused $q_b$ to compensate, but because of inherent lags in the response of $\rho_{mix}$ to changes in $q_w$ and the simulated response characteristics of the boost mud flow controller, the compensation was not perfect, as evidenced by the perturbations in total mud flow ($q_w$+$q_b$). Initially, $p_{rb}$ declined about 16 psi (110 kPa) due to the reduction in $q_w$. Although flow perturbations at the base of the riser ceased at about 25 minutes (see FIG. 9A), $p_{rb}$ continued to vary in an oscillatory manner for a long time with a maximum deviation of +76 psi (+524 kPa) as the perturbed mixture reached the surface. Although this deviation may not be excessive, it illustrates the sensitivity of $p_{rb}$ to even small perturbations in $\dot{m}_i$, particularly as these perturbations move up the riser. Other simulations with larger orifices (less frictional damping) exhibited even larger variations.

Figure 10:
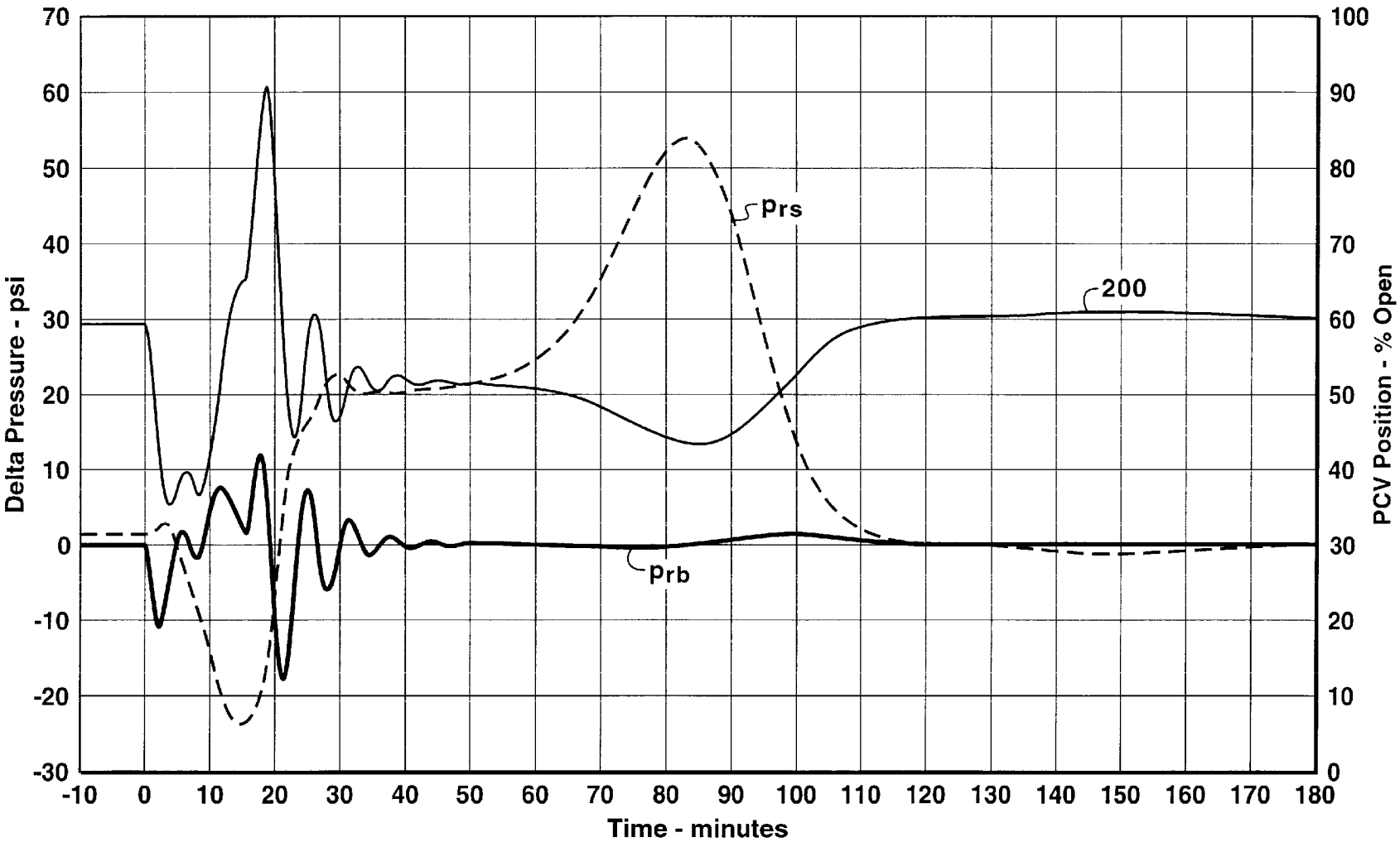
FIG. 10 illustrates the results of a simulation of the response of the pressure control system to a transient event when only the first element (control of riser surface pressure ($p_{rs}$) and mass flow out of the riser ($\dot{m}_o$)) is used.

FIG. 10 illustrates the effect of using only surface control of $p_{rs}$ and $\dot{m}_o$ for a comparable transient condition. In this instance, $q_w$ was initially 600 gpm (2271 lpm) with no boost mud. The pressure control valve at the surface was simulated as a throttling valve in the outlet from the riser. This valve was initially about 60% open, as evidenced by curve 200, resulting in a riser surface pressure ($p_{rs}$) of 300 psi (2068 kPa).

As with the previous simulation, the pump shutdown began at zero minutes and $q_w$ (not shown) declined from 600 gpm (2271 lpm) to the same 268 gpm (1015 lpm) minimum value before returning to 600 gpm (2271 lpm).

Although the pressure control valve initially closed from about 60% to about 35%, $p_{rs}$ actually declined because the flow through it declined. Despite some oscillatory behavior, $p_{rb}$ began to increase and the pressure control valve opened to about 90% at the time $p_{rb}$ peaks at +12 psi (+82.7 kPa) relative to its desired value. This time also corresponds approximately to when $q_w$ has been restored to 600 gpm (2271 lpm). Subsequently, $p_{rb}$ drops to −18 psi (−124.1 kPa) and then returns to its initial value in a damped oscillatory manner.

It is evident in FIG. 10 that the pressure control valve is effective in controlling $p_{rb}$ during the initial perturbations (0–30 minutes) and especially later as the perturbed mixture rises and exits the riser (40–110 minutes). However, to achieve this control, the pressure control valve had to range from 35% to 90% open and $p_{rs}$ varied from −24 psi (−165.5 kPa) to +53 psi (+365.4 kPa) about its initial value of 300 psi (2068 kPa). While these values are not unacceptable, it is evident that a longer shutdown in circulation would have ultimately caused the pressure control valve to reach its limit of control.

Figure 11:
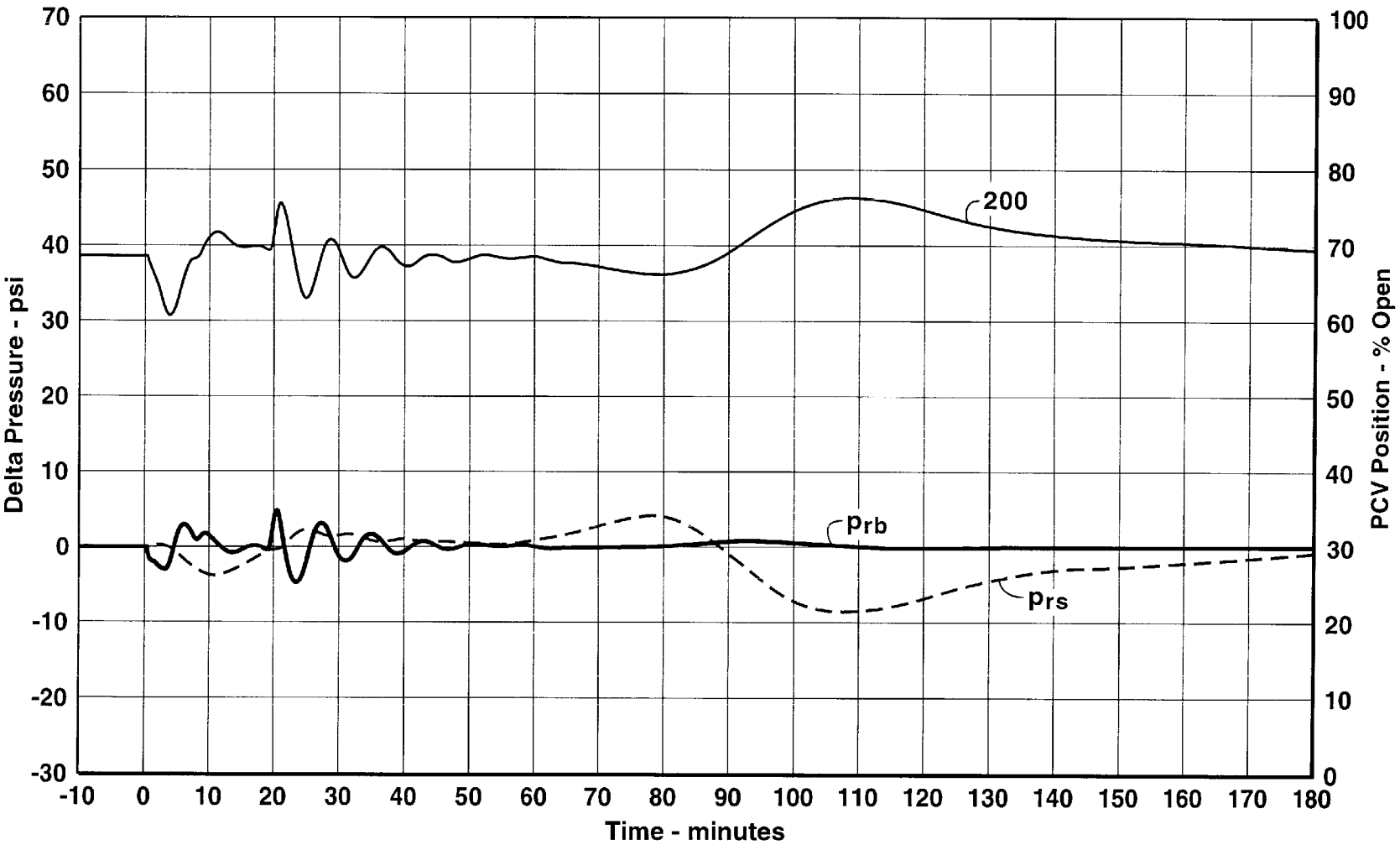
FIG. 11 illustrates the results of a simulation of the response of the pressure control system to a transient event using both elements of the dual-element control system.

FIG. 11 contains the results of a simulation in which both control elements were employed. The initial values and transient behavior of $q_w$ and $q_b$ were the same as in FIG. 9A. The initial position of the pressure control valve was 68% open resulting in a $p_{rs}$ value of 285 psi (1965 kPa), as in FIG. 9B. In this case, $p_{rb}$ exhibited behavior similar to that of FIG. 10, but with even better initial control (±5 psi (±34.5 kPa) versus +12/−18 psi (+82.7/−124.1 kPa)). Furthermore, the demand on the pressure control valve was greatly reduced (ranging only from 60% to 75% open) and the variations in $p_{rs}$ were small (+4/−9 psi) (+27.6/−62.0 kPa).

These simulations clearly indicate the advantage of simultaneously employing both control elements.

Kick/Lost Circulation Detection System

While the change in flow caused by mud pump shutdowns can be anticipated, kicks and lost circulation are unplanned occurrences that can lead to catastrophic events (blowouts) unless detected and controlled at an early stage. The 1979 paper by Maus referred to above states that instrumentation for detecting kicks or lost circulation in deep water should be capable of sensing changes in $q_w$ (or more specifically, $\Delta q$) of about 25 to 50 gpm (94.6 to 189.2 lpm). Once an apparatus is designed to perform the control functions described above, it is straightforward to modify it to compare the computed value of $q_w$ to the circulating rate $q_c$ in order to detect kicks and lost circulation while drilling. Essentially, the apparatus needs only to solve equation (10) for $\Delta q$. As long as the volume of mud in the drill string is constant (during circulation or after a pump shutdown of about 30 minutes or longer), changes in $q_w$ can be interpreted as gains or losses from or to the subsurface formation. However, during the period immediately following a pump shutdown or startup, the mud volume in the drill string will change because of hydrostatic imbalances between the fluid in the drill string and the wellbore/riser column. During these periods, the system will compute a $\Delta q$ that is indicative of the drainage or fill-up of the drill string, as well as any kicks or lost circulation. Since the flow resulting from drainage or fill-up of the drill string is a repeatable and predictable phenomenon, particularly if periodically calibrated during the drilling process, gas lift computer 80 may be programmed to compute these flow effects, permitting detection of kicks and lost circulation even during these transient periods.

Since the initial manifestation of a kick is an increase in $q_w$, the automatic response of the pressure control system will be to reduce $q_b$ to compensate. The principal reason for establishing a positive value of $q_b$ (e.g., 60 gpm (227.1 lpm)) under base or steady-state conditions is to provide some flexibility for reducing $q_b$ in the event of a kick or other transient increase in $q_w$ or cuttings load ($\rho_w$). Simulations have demonstrated, however, that the dual-element control system described herein is capable of maintaining $P_{rb}$ relatively constant even if the transient increase in $q_w$ greatly exceeds the ability of $q_b$ to fully compensate.

The response of the control system to lost circulation or a decrease in cuttings load ($\rho_w$) will be the opposite of that described above. In this, instance, there is even more flexibility for compensation by increasing $q_b$ since this will be limited only by the hydraulic capacity of the boost mud system.

Studies of the occurrence of well control problems (kicks or lost circulation) have indicated that a large fraction of these incidents are initiated while moving (tripping) drill pipe into or out of a well. Vertical drill pipe movement can cause large pressure increases (surge) or decreases (swab) within the well. These can cause formation fracture and loss of drilling mud or influxes of formation fluid. These events typically occur when there is no circulation of drilling mud ($q_c$=0). The conventional method of detecting kicks or mud losses while tripping is to use a calibrated tank ("trip tank") at the surface to measure the volume of mud displaced from the well (tripping in) or required to fill the well (tripping out). This volume should match that of the drill pipe being inserted in or removed from the well. With the proposed system (see FIG. 7A) it is assumed that the gas lift will continue to operate with mud flow from the boost line as for other conditions with no circulation. With the bypass isolation valves 106 open, annular stripper 101 in LMRP 20 will be closed around the drill pipe 22. The drill pipe 22 will be stripped into or out of the well through this seal. Mud displaced from or into the well will flow through the bypass flowmeter 108 and can be totalized (integrated) to determine whether the volume correctly matches that of the drill pipe 22. In this fashion, the bypass flowmeter 108 will replace the trip tank.

Once a kick has been detected, the influx of formation fluids is stopped and the formation fluids are circulated out of the well under control of subsea choke 115 (FIG. 7A). If the kick is detected while drilling mud is being circulated down drill string 22, circulation is continued throughout the procedure at a constant rate, preferably predetermined and adequate to keep the drill pipe full of mud. With reference to FIGS. 7A and 7B, choke line isolation valve 111 is closed, subsea choke 115 is opened fully, subsea choke isolation valves 113 are opened, and the BOP choke side outlet valves 137 below the BOP to be closed are opened. Once a flow path through the subsea choke 115 and subsea choke flow line 109 is established, one or more BOPs are closed to divert flow from the BOP annulus through subsea choke 115 and into the base of riser 10. Subsea choke 115 is progressively closed, increasing the pressure in the well, until the value of $\Delta q$ as computed by gas lift computer 80 becomes zero. At this point, the influx of formation fluids has been stopped, and the wellbore pressure is equal to the pore pressure of the formation from which the kick originated. This pressure can be determined by observing standpipe pressure 48 (FIG. 2) and correcting it for the hydrostatic and frictional pressures through the drill string. These pressures are known, having been calculated and/or calibrated as part of standard drilling procedures.

The operator then remotely controls the opening of subsea choke 115 to maintain a constant standpipe pressure at a value equal to or somewhat greater than that observed when $\Delta q$ was initially reduced to zero. This ensures that the wellbore pressure is equal to or greater than the formation pore pressure and that no further influx of formation fluids will occur. This type of control continues until all formation fluids have been circulated out of the well and into the riser 10 through subsea choke 115. Higher density drilling mud is then circulated into the well according to procedures long established in the offshore drilling industry.

During these kick events, the pressure control system will continue to attempt to maintain a constant value of $p_{rb}$ as described above. During the period when $\Delta q$ is greater than zero, the system will reduce $q_b$ to compensate for the higher flow $q_w$. When the formation fluids (gas, oil, or water) begin to enter riser 10 from subsea choke 115, they normally will be less dense than the drilling mud and reduce the value of $\rho_{mix}$. The pressure control system will then increase $q_b$ to restore $\rho_{mix}$ to its setpoint value. Depending on the density and rate of circulation of the light formation fluid, particularly if it is gas, it may be necessary to desirable to reduce the flow $q_g$ of lift gas temporarily. This can be accomplished manually or automatically under control of gas lift computer 80.

A similar procedure may be used if a kick is detected while the drill string is being tripped out of or into the well, and drilling mud is not being circulated through it. As described above, the gas lift system will be operating with boost mud as the supply of liquid and the drill string will be partially filled with drilling mud. In this instance, a BOP (preferably an annular BOP) is closed around the drill pipe 22 to stop the influx of formation fluids and the drill string is lowered ("stripped") into the well through the closed BOP. Bypass flow line 104 may be used to bleed the mud out of the well displaced by the drill pipe and bypass flow meter 108 may be used to monitor this volume to ensure that it does not exceed the appropriate amount, thereby indicating a secondary kick. Once the drill bit is at the bottom of the well, circulation down the drill string is restarted and, while the drill string is filling, the flow path through subsea choke 115 is established. Once the air in the drill string is circulated out of the drill bit, it is possible to determine the pressure at the bottom of the well from the standpipe pressure 48. Since the well is under control, the bottom hole pressure is equal to or greater than the formation pressure and control of subsea choke 115 to maintain a constant standpipe pressure will ensure no further influx. The formation fluids are circulated out of the well using procedures outlined above.

A lost circulation event would be indicated by a delta flow ($\Delta q$) value less than zero. Conventional procedures for dealing with lost circulation problems, such as adding a bridging material to the drilling mud, would then be used to correct the problem. Throughout the lost circulation event, the pressure control system would attempt to maintain $p_{rb}$ approximately equal to the ambient seawater pressure by increasing $q_b$ and/or by increasing $p_{rs}$ and reducing $\dot{m}_o$, as described above.

"Permanent" Changes

In the above description of the behavior of the present invention, it was assumed that the events were "transient," i.e., that flow conditions would ultimately return to their original values once the transient event was over. In such events, it is unlikely that adjustments in the lift gas injection rate ($q_g$) will be necessary or desirable considering the apparent effectiveness of the proposed dual-element control system. However, as noted above, permanent changes, or perhaps very long term transient changes, may require adjustment of $q_g$ in order to re-establish the desired base or steady-state values of $q_b$ and surface pressure control valve position. It is preferred that these adjustments be manual since judgment will be required in many instances as to whether the changes are transient or permanent and whether the values of $q_b$ and $p_{rs}$ and the surface pressure control valve position are acceptable under specific operating conditions.

Alternate Embodiments

The foregoing description has been directed to particular embodiments of the invention for the purpose of illustrating the invention. It will be apparent to persons skilled in the art, however, that many modifications and variations to the embodiments described herein are possible. Also, a number of features are relatively arbitrary and could be altered without changing the essential characteristics of the pressure control system. Several such possible modifications are listed below.

- If a practical and reliable means of directly measuring $q_w$ were available, the computations of equations (6) through (9b) would be unnecessary and the system would be simplified.
- Means other than differential pressure may be used to measure $\rho_{mix}$ and $\rho_w$, particularly in the configuration of FIG. 1B. For example, gamma-ray densitometers might be used since there would be no interference from the drill string.
- Alternate locations (other than at the surface) for measuring $q_b$ and/or $\rho_b$.
- Alternate locations for measurement of $q_g$. Depending on location, this measurement may require correction for pressure and temperature.
- Direct measurement of $\rho_g$ rather than calculation based on ambient seawater pressure and temperature.
- Measurement of $p_{rb}$ instead of the differential between $p_{rb}$ and the pressure of the surrounding seawater.
- Combining the functions of the variable choke in the boost mud line and the boost mud flow control valve into a single component.
- Use of redundant measurement and control devices for reliability.
- Addition of other valves, piping, etc. to provide isolation and flexibility and to integrate this system into existing drilling control systems.
- Descriptions herein of system operation refer to conventional overbalanced drilling where the pressure of the drilling mud in open-hole sections of the well is maintained greater than the pressure of formation fluids in the exposed formations. However, the present invention may also be used in underbalanced drilling where the mud pressure is less than the pressure of the formation fluids and the well is allowed to flow.
- Descriptions herein of system operation refer to conventional drilling with jointed drill pipe, rotated by a device on the floating vessel or platform. With this system, the most frequent and substantial perturbations to flow at the base of the riser are the interruptions in circulation necessary when additional drill pipe must be added. An alternative drilling system, known as coiled tubing (CT) drilling, uses a long string of tubing or pipe that is coiled on a large reel and is unreeled as the well is drilled deeper. The bit is rotated by a device near the bottom of the drill string, known as a mud motor, driven by the circulation of mud through it. Therefore, the CT drilling system differs from the conventional system in that interruptions in circulation are very infrequent and the drill pipe is not rotated. The present invention is applicable to this type of drilling system, particularly in the embodiment that involves control of $p_{rb}$ using only surface control of $p_{rb}$ and $\dot{m}_o$. Since circulation from the Well is essentially constant, the need for compensation using boost mud is reduced.

All such modifications and variations are intended to be within the scope of the present invention, as defined by the appended claims.

We claim:

1. A method for controlling the pressure at the base of a gas-lifted riser during drilling of an offshore well, said method comprising the steps of:

determining the riser base pressure ($p_{rb}$); and using a throttling device located at or near the top of said riser to adjust the mass flow rate out of the top of said riser ($\dot{m}_o$) and the riser surface pressure ($p_{rs}$) to compensate for changes In the riser base pressure ($p_{rb}$).

2. A method for controlling the pressure at the base of a gas-lifted riser during drilling of an offshore well, said method comprising the steps of:

determining the mass flow rate into the base of said riser ($\dot{m}_i$); and adjusting one or both of the boost mud flow rate ($q_b$) and the lift gas flow rate ($q_g$) to substantially minimize variations in the mass flow rate into the base of said riser ($\dot{m}_i$).

3. The method of claim 2, wherein the step of determining the mass flow rate into the base of said riser ($\dot{m}_i$) further comprises the steps of:

determining boost mud density ($\rho_b$), boost mud flow rate ($q_b$) lift gas density ($\rho_g$), lift gas flow rate ($q_g$), well return density ($\rho_w$) and well return flow rate ($q_w$); and calculating the mass flow rate into the base of said riser ($\dot{m}_i$), where $$\dot{m}_i=\rho_w q_w+\rho_b q_b+\rho_g q_g.$$

4. The method of claim 3, wherein the step of determining the well return flow rate ($q_w$) further comprises the steps of:

determining lift gas absolute temperature ($T_g$), riser mix density ($\rho_{mix}$), and riser mix absolute temperature ($T_{mix}$); and calculating the well return flow rate ($q_w$), where $$q_w=Aq_g-Bq_b,$$

$$A=([T_{mix}/T_g]\rho_{mix}-\rho_g)/(\rho_w-\rho_{mix}),$$

$$B=(\rho_b-\rho_{mix})/(\rho_w-\rho_{mix}).$$

5. The method of claim 3, wherein said method further comprises the steps of:

determining the drill string flow rate ($q_c$), and comparing the drill string flow rate ($q_c$) to the well return flow rate ($q_w$) to detect well control problems such as kicks or lost circulation.

6. A method for controlling the pressure at the base of a gas-lifted riser during drilling of an offshore well, said method comprising the steps of:

determining riser base pressure ($p_{rb}$) and the mass flow rate into the base of said riser ($\dot{m}_i$);

using a throttling device located at or near the top of said riser to adjust the mass flow rate out of the top of said riser ($\dot{m}_o$) and the riser surface pressure ($p_{rs}$) to compensate for changes in the riser base pressure ($p_{rb}$); and adjusting one or both of the boost mud flow rate ($q_b$) and the lift gas flow rate ($q_g$) to substantially minimize variations in the mass flow rate into the base of said riser ($\dot{m}_i$).

7. The method of claim 6, wherein the step al determining the mass flow rate into the base of said riser ($\dot{m}_i$) further comprises the steps of:

determining boost mud density ($\rho_b$), boost mud flow rate ($q_b$), lift gas density ($\rho_g$), lift gas flow rate ($q_g$), well return density ($\rho_w$), and well return flow rate ($q_w$); and calculating the mass flow rate into the base of said riser ($\dot{m}_i$), where $$\dot{m}_i=\rho_w q_w+\rho_b q_b+\rho_g q_g.$$

8. The method of claim 7, wherein the step of determining the well return flow rate ($q_w$) further comprises the steps of:

determining lift gas absolute temperature ($T_g$), riser mix density ($\rho_{mix}$), and riser mix absolute temperature ($T_{mix}$); and calculating the well return flow rate ($q_w$), where $$q_w=Aq_g-Bq_b,$$

$$A=([T_{mix}/T_g]\rho_{mix}-\rho_g)/(\rho_w-\rho_{mix}),$$

$$B=(\rho_b-\rho_{mix})/(\rho_w-\rho_{mix}).$$

9. The method of claim 7, wherein said method further comprises the steps of:

determining the drill string flow rate ($q_c$); and comparing the drill string flow rate ($q_c$) to the well return flow rate ($q_w$) to detect well control problems such as kicks or lost circulation.

10. A method for controlling the pressure at the base of a gas-lifted riser during drilling of an offshore well, said method comprising the steps of:

determining boost mud density ($\rho_b$), boost mud flow rate ($q_b$), lift gas density ($\rho_g$), lift gas absolute temperature ($T_g$), lift gas flow rate ($q_g$), riser mix density ($\rho_{mix}$), riser mix absolute temperature ($T_{mix}$), well return density ($\rho_w$) and riser base pressure ($p_{rb}$);

calculating the well return flow rate ($q_w$), where $$q_w=Aq_g-Bq_b,$$

$$A=([T_{mix}/T_g]\rho_{mix}-\rho_g)/(\rho_w-\rho_{mix}),$$

$$B=(\rho_b-\rho_{mix})/(\rho_w-\rho_{mix});$$

calculating the mass flow rate into the base of said riser ($\dot{m}_i$), where $$\dot{m}_i=\rho_w q_w+\rho_b q_b+\rho_g q_g;$$

adjusting the mass flow rate out of the top of said riser ($\dot{m}_o$) and the riser surface pressure ($p_{rs}$) to compensate for changes In the riser base pressure ($p_{rb}$); and adjusting one or both of the boost mud flow rate ($q_b$) and the lift gas flow rate ($q_g$) to minimize variations in the mass flow rate into the base of said riser ($\dot{m}_i$).

11. The method of claim 10, wherein said method further comprises the steps of:

determining the drill string flow rate ($q_c$); and comparing the drill string flow rate ($q_c$) to the well return flow rate ($q_w$) to detect well control problems such as kicks or lost circulation.

12. A method for controlling the pressure at the base of a gas-lifted riser during drilling of an offshore well, said method comprising the steps of:

a) determining a setpoint value for riser mix density ($\rho_{mix}$);

b) determining the actual value of riser mix density ($\rho_{mix}$);

c) adjusting one or both of the boost mud flow rate ($q_b$) and the lift gas flow rate ($q_g$), to substantially minimize the difference between said setpoint value and said actual value;

d) determining well return flow rate ($q_w$) and drill string flow rate ($q_c$);

e) comparing the drill string flow rate ($q_c$) to the well return flow rate ($q_w$) to detect well control problems such as kicks or lost circulation;

f) determining boost mud density ($\rho_b$), boost mud flow rate ($q_b$), lift gas density ($\rho_g$), lift gas flow rate ($q_g$), lift gas absolute temperature ($T_g$), well return density ($\rho_w$), riser mix density ($\rho_{mix}$), and riser mix absolute temperature ($T_{mix}$); and g) calculating the well return flow rate ($q_w$), where $$q_w = Aq_g - Bq_b,$$

$$A = ([T_{mix}/T_g]\rho_{mix} - \rho_g)/(\rho_w - \rho_{mix}),$$

$$B = (\rho_b - \rho_{mix})/(\rho_w - \rho_{mix}).$$

13. Apparatus for controlling the pressure at the base of a gas-lifted riser during drilling of an offshore well, said apparatus comprising:

means for determining the mass flow rate into the base of said riser ($\dot{m}_i$); and means for adjusting one or both of the boost mud flow rate ($q_b$) and the lift gas flow rate ($q_g$) to substantially minimize variations in the mass flow rate into the base of said riser ($\dot{m}_i$).

14. The apparatus of claim 13, wherein said means for determining the mass flow rate into the base of said riser ($\dot{m}_i$) comprises:

means for determining boost mud density ($\rho_b$), boost mud, flow rate ($q_b$), lift gas density ($\rho_g$), lift gas flow rate ($q_g$), well return density ($\rho_w$) and well return flow rate ($q_w$); and means for calculating the mass flow rate into the base of said riser ($\dot{m}_i$), where $$\dot{m}_i = \rho_w q_w + \rho_b q_b + \rho_g q_g.$$

15. The apparatus of claim 14, wherein said means for determining well return density ($\rho_w$) comprises a differential pressure transducer adapted to measure the pressure differential between two vertically spaced-apart points in the lower end of said riser.

16. The apparatus of claim 14, wherein said means for determining the well return flow rate ($q_w$) comprises:

means for determining lift gas absolute temperature ($T_g$), riser mix density ($\rho_{mix}$), and riser mix absolute temperature ($T_{mix}$); and means for calculating the well return flow rate ($q_w$), where $$q_w = Aq_g - Bq_g,$$

$$A = ([T_{mix}/T_g]\rho_{mix} - \rho_g)/(\rho_w - \rho_{mix}),$$

$$B = (\rho_b - \rho_{mix})/(\rho_w - \rho_{mix}).$$

17. The apparatus of claim 14, said apparatus further comprising:

means for determining the drill string flow rate ($q_c$); and means for comparing the drill string flow rate ($q_c$) to the well return flow rate ($q_w$) to detect well control problems such as kicks or lost circulation.

18. The apparatus of claim 13, wherein said means for adjusting one or both of the boost mud flow rate ($q_b$) and the lift gas flow rate ($q_g$) comprise surface-controlled flow control valves installed in the lift gas injection line and the boost mud line.

19. Apparatus for controlling the pressure at the base of a gas-lifted riser during drilling of an offshore well, said apparatus comprising:

means for determining riser base pressure ($p_{rb}$) and the mass flow rate into the base of said riser ($\dot{m}_i$);

a throttling device for adjusting the mass flow rate out of the top of said riser ($\dot{m}_o$) and the riser surface pressure ($p_{rs}$) to compensate for changes in the riser base pressure ($p_{rb}$), said throttling device being located at or near the top of said riser; and means for adjusting one or both of the boost mud flow rate ($q_b$) and the lift gas flow rate ($q_g$) to substantially minimize variations in the mass flow rate into the base of said riser ($\dot{m}_i$).

20. The apparatus of claim 19, wherein said means for determining the mass flow rate Into the base of said riser ($\dot{m}_i$) comprises:

means for determining boost mud density ($\rho_b$), boost mud flow rate ($q_b$), lift gas density ($\rho_g$), lift gas flow rate ($q_g$), well return density ($\rho_w$) and well return flow rate ($q_g$); and means for calculating the mass flow rate into the base of said riser ($\dot{m}_i$), where $$\dot{m}_i = \rho_w q_w + \rho_b q_b + \rho_g q_g.$$

21. The apparatus of claim 20, wherein said means for determining the well return flow rate ($q_w$) comprises:

means for determining lift gas absolute temperature ($T_g$), riser mix density ($\rho_{mix}$), and riser mix absolute temperature ($T_{mix}$); and means for calculating the well return flow rate ($q_w$), where $$q_w = Aq_g - Bq_b,$$

$$A = ([T_{mix}/T_g]\rho_{mix} - \rho_g)/(\rho_w - \rho_{mix}),$$

$$B = (\rho_b - \rho_{mix})/(\rho_w - \rho_{mix}).$$

22. The apparatus of claim 21, said apparatus further comprising:

means for determining the drill string flow rate ($q_c$); and means for comparing the drill string flow rate ($q_c$) to the well return flow rate ($q_w$) to detect well control problems such as kicks or lost circulation.

23. Apparatus for controlling the pressure at the base of a gas-lifted riser during drilling of an offshore well, said apparatus comprising:

means for determining boost mud density ($\rho_b$) boost mud flow rate ($q_b$), lift gas density ($\rho_g$), lift gas absolute temperature ($T_g$), lift gas flow rate ($q_g$), riser mix density ($\rho_{mix}$), riser mix absolute temperature ($T_{mix}$), well return density ($\rho_w$) and riser base pressure ($p_{rb}$);

means for calculating the well return flow rate ($q_w$), where $$q_w = Aq_g - Bq_b,$$

$$A = ([T_{mix}/T_g]\rho_{mix} - \rho_g)/(\rho_w - \rho_{mix}),$$

$$B = (\rho_b - \rho_{mix})/(\rho_w - \rho_{mix});$$

means for calculating the mass flow rate into the base of said riser ($\dot{m}_i$), where $$\dot{m}_i = \rho_w q_w + \rho_b q_b + \rho_g q_g;$$

means for adjusting the mass flow rate out of the top of said riser ($\dot{m}_o$) and the riser surface pressure ($p_{rs}$) to compensate for changes in the riser base pressure ($p_{rb}$); and means for adjusting one or both of the boost mud flow rate ($q_b$) and the lift gas flow rate ($q_g$) to minimize variations in the mass flow rate into the base of said riser ($\dot{m}_i$).

24. The apparatus of claim 23, said apparatus further comprising:

means for determining the drill string flow rate ($q_c$); and means for comparing the drill string flow rate ($q_c$) to the well return flow rate ($q_w$) to detect well control problems such as kicks or lost circulation.

25. Apparatus for controlling the pressure at the base of a gas-lifted riser during drilling of an offshore well, said apparatus comprising:

means for determining the actual value of riser mix density ($\rho_{mix}$);

means for adjusting one or both of the boost mud flow rate ($q_b$) and the lift gas flow rate ($q_g$) to substantially minimize differences between said actual value of riser mix density ($\rho_{mix}$) and a predetermined setpoint value of riser mix density ($\rho_{mix}$);

means for determining the drill string flow rate ($q_c$);

means for determining he well return flow rate ($q_w$), wherein said means for determining comprises means for determining boost mud density ($\rho_b$), boost mud flow rate ($q_b$), lift gas density ($\rho_g$), lift gas flow rate ($q_g$), lift gas absolute temperature ($T_g$), well return density ($\rho_w$), riser mix density ($\rho_{mix}$), and riser mix absolute temperature ($T_{mix}$);

means for calculating the well return flow rate ($q_w$), where $$q_w = Aq_g - Bq_b,$$

$$A = ([T_{mix}/T_g]\rho_{mix} - \rho_g)/(\rho_w - \rho_{mix}),$$

$$B = (\rho_b - \rho_{mix})/(\rho_w - \rho_{mix}); \text{ and}$$

means for comparing the drill string flow rate ($q_c$) to the well return flow rate ($q_w$) to detect well control problems such as kicks or lost circulation.

* * * * *